US005964304A

United States Patent [19]

Morrison, Jr. et al.

[11] Patent Number: 5,964,304

[45] Date of Patent: Oct. 12, 1999

[54] METHOD AND APPARATUS FOR DRILL CUTTINGS TRANSFER

[76] Inventors: Sidney Johnson Morrison, Jr., 215 E. Bayview, Apt. A, Portland, Tex. 78374; Dietmar Jurgen Neidhardt, 129 Grogans Point Rd., The Woodlands, Tex. 77380

[21] Appl. No.: 09/075,125

[22] Filed: May 8, 1998

[51] Int. Cl.[6] ..... E21B 21/06

[52] U.S. Cl. ..... 175/38; 175/206; 175/207; 210/738; 210/739

[58] Field of Search ..... 175/38, 66, 206, 175/207; 210/738, 739

[56] References Cited

U.S. PATENT DOCUMENTS

| | | | |
|---|---|---|---|
| 2,919,898 | 1/1960 | Marwil et al. . | |
| 3,016,962 | 1/1962 | Lummus et al. . | |
| 3,693,733 | 9/1972 | Teague . | |
| 4,348,279 | 9/1982 | Tikhonov et al. | 210/96.1 |
| 4,413,511 | 11/1983 | Godbey . | |
| 4,546,783 | 10/1985 | Lott . | |
| 4,571,296 | 2/1986 | Lott . | |
| 5,090,498 | 2/1992 | Hamill . | |
| 5,109,933 | 5/1992 | Jackson . | |
| 5,129,469 | 7/1992 | Jackson . | |
| 5,303,786 | 4/1994 | Prestridge et al. | 175/206 X |
| 5,344,570 | 9/1994 | McLachlan et al. . | |
| 5,402,857 | 4/1995 | Dietzen . | |
| 5,564,509 | 10/1996 | Dietzen . | |
| 5,839,521 | 11/1998 | Dietzen | 175/66 |
| 5,842,529 | 12/1998 | Dietzen | 175/206 X |

OTHER PUBLICATIONS

"Document U" is product information titled "Specifications—Roots RCS Rotary Positive Blowers," which contains information regarding blowers, (1 page).

"Document V" is a Safeguard/SWACO brochure entitled "Total Cuttings Containment for Zero Discharge Offshore." Dual hoppers are configured in series with one hopper discharging cuttings into a second hopper. A slurrification unit application is also references (4 pp.).

"Document M" is a printout from a patent related database.

"Document N" is a copy of a product catalog titled "MARTIN" "VIBROLLER" Vibrators by Martin Engineering. (8 pp).

"Document O" is an excerpt from a product catalog by Bush & Wilton Valves, Inc. (12 pp).

"Document P" is product information titled "Oiltools Solids Control Services," which contains information regarding slurrification units. (6 pp).

"Document Q" is a product information brochure for the SM 6000 Sand Max, which utilizes a suction force in conjunction with a wheeled hopper rolling on an onshore container. (2 pp).

"Document R" is a picture of a single hopper used in connection with the Max–Vac, Inc., "SM 6000 Sand Max." (1 page).

"Document S" is a product information brochure for the "Max–Vac SM 5000," which has been utilized for offshore drilling rig management of solids, but not drill cuttings, in conjunction with box type containers, but with no hoppers being utilized. (2 pp).

"Document T" is a picture of a Max–Vac, Inc., blower and tank being used to remove drilling mud from a barge. (1 page).

*Primary Examiner*—Roger Schoeppel
*Attorney, Agent, or Firm*—George S. Gray

[57] ABSTRACT

Methods and apparatus are provided for the uninterrupted transfer of oil and gas well drill cuttings from a collection point, such as a shale shaker trough, to several types of variously configured on rig and off rig receptacles. Two or more hoppers are arranged for alternating receipt and discharge of cuttings, the cuttings being continuously drawn to the hoppers by a suction force from an upstream blower. The receptacles utilized in the various embodiments are varied, such as barges, box containers, and slurry units. The hoppers are, in some embodiments, moved to remote locations, such as off rig barges, prior to beginning the cuttings transfer.

102 Claims, 16 Drawing Sheets

METHOD AND APPARATUS FOR DRILL CUTTINGS TRANSFER

BACKGROUND OF THE INVENTION

In oil and gas well drilling operations, drilling fluid is circulated through the drill string, returning formation drill cuttings to the surface through the annulus. The formation drill cuttings are removed from the drilling fluid so that the drill fluid may be reused. A "shale shaker" is typically used for this purpose, which results in drill cuttings accumulating in a trough. The accumulated drill cuttings must be removed from the trough and appropriate disposal must be arranged.

Several methods for removing drill cuttings from the shale shaker trough are known, including various configurations of conveyors, chutes, suction lines, tanks, and other devices. Industry experience has shown that the utilization of a suction line provides several benefits not found in other methods including easier installation, quicker installation, less moving parts, improved safety, lower maintenance, and reduced expense.

Current methods and apparatus utilized in the suction line methods suffer, among other things, from an inability to dispose of the suctioned drill cuttings without interrupting the suction force. This causes substantial delays, and attempts to address this problem have not proven satisfactory.

One known method of utilizing a suction line to remove drill cuttings from the shale shaker trough, involves a tank in which a suction is created, drawing drill cuttings into the tank until full. Once full, however, the suction force must be broken, the suction force connection equipment must be removed from the tank, and the tank must be sealed for removal and replacement by an empty tank. This method in particular has been known to cause substantial delays. Another method involves a single hopper in which a suction force is created, again drawing drill cuttings into the hopper until full. This method also suffers in that the suction force must be terminated in order for the hopper to be opened for discharge of the accumulated drill cuttings.

Known suction line methods also suffer from an inability to properly and efficiently adapt to various methods of disposing of the drill cuttings once they have been removed from the shale shaker trough. For example, although the suction line method utilizing a single hopper can be configured to discharge from the single hopper into a "slurrification unit," the method does not appropriately address the presence of two receiving tanks on most of such slurry units. A slurrification unit typically has two circulating systems, each involving the formulation of a slurry consisting of water and the drill cuttings, with the slurry being circulated, and the cuttings ground to a sufficiently small size for ultimate discharge to an injection pump. The injection pump forces the slurry down the well for reintroduction into porous formations. Any suction line method having only a single hopper discharging into only one slurrification unit tank, fails to take full advantage of the capabilities of the two tank slurrification unit dual circulating systems.

Methods and apparatus are needed which will provide suction line retrieval of drill cuttings from the shale shaker trough, provide continuous suction force in the system, enable efficient post-suction collection and disposal of the drill cuttings, and fully complement the two tank slurrification unit system.

SUMMARY OF THE INVENTION

Our invention provides methods and apparatus for suctioning drill cuttings from a shale shaker trough, using a continuous suction force in the system, and further enabling efficient post-suction collection and disposal of the drill cuttings. Such methods and apparatus are fully complementary to a slurrification unit system having two tanks and two corresponding circulation systems.

Our suctioning method involves a suction force which pulls cuttings from the shale shaker trough. The cuttings are pulled, in an alternative fashion, to a first hopper and then a second hopper. When a hopper has the appropriate amount of drill cuttings accumulated within it, suction is broken within that hopper only, and the cuttings are discharged into one or more receptacles. In a similar manner, suction is broken in the other hopper when it has received the appropriate amount of drill cuttings, followed by cuttings discharge. These steps are timed such that the first hopper discharges cuttings while the second hopper is filling and the second hopper discharges cuttings while the first hopper is filling.

Our suctioning method can be accomplished such that the suctioning force is continuously present at the shale shaker trough, and in either the first or the second hopper. It can also be accomplished such that the receipt of cuttings into the first hopper, the breaking of the suction force in the second hopper, and the discharge of cuttings from the second hopper begin simultaneously, or substantially simultaneously, and similarly, that the receipt of cuttings into the second hopper, the breaking of the suction force in the first hopper, and the discharge of cuttings from the first hopper also begin simultaneously, or substantially simultaneously. A blower provides the suction force, and our invention includes the capturing of any liquids in the air after the air leaves the hoppers, but before it reaches the blower.

Our invention includes several improved methods of receiving suctioned drill cuttings after the first post-suction accumulation. For example, the two hoppers can be spaced and located in appropriate proximity to a "train" of receptacles, such that the filled receptacle can be moved and replaced by an empty receptacle during a period of non-discharge from our two hopper system. This exchange of receptacles can be accomplished with no cessation of the suctioning force. Embodiments such as this can be readily utilized both onshore and offshore.

Our invention also provides for the reception of discharged drill cuttings from the first hopper into a first receptacle and from the second hopper into a second receptacle. With the hopper so configured, a two "train" system for moving and replacing receptacles is provided.

Our invention also includes the movement of the two hoppers from a first discharge location to a second discharge location, such that a different receptacle is being filled at each location. This multiple receptacle method allows the movement and replacement of a filled container while the hoppers are above a different container.

Also included as a method in our invention is the spacing of the first and second hoppers for even distribution of the discharged drill cuttings into a receptacle.

Our invention includes the positioning of the hoppers off of the drilling rig prior to receiving drill cuttings. This allows the discharge of the drill cuttings from the hoppers to occur in a wide variety of receptacles, such as barges, other ships with storage compartments, trucks, etc.

Our invention is particularly adaptable to compartmentalized receptacles. The hoppers can be spaced such that the first and second hoppers coincide with pairs of compartments within a single receptacle. Furthermore, the hoppers can be moved in such a fashion as to analogously coincide with additional pairs of compartments. Moving such a receptacle with respect to stationary hoppers is also included.

Our invention also provides for the hoppers to be mounted on, and moved along, guide fixtures and combinations of guide frames and guide fixtures. This allows the placement of cuttings in an evenly distributed fashion in single opening receptacles, and also allows movement between compartments on compartmentalized receptacles, e.g. barges. Both lateral and longitudinal movement is provided, as well as, independent movement of the hoppers with respect to each other. Mounting each hopper on an independent guide fixture is also included.

Our invention also includes the routing of the discharged cuttings from the two hoppers to a common point for further routing. Such further routing can be along a single path or can be divided into two or more paths, for alternate discharge routing into two or more receptacles. Our invention includes both a redirectable single discharge routing and a dual discharge routing, both of which will be particularly adaptable to the two tank slurrification unit system. In this application, the combined discharged cuttings from both hoppers would be first directed to the slurrification unit first tank, and at an appropriate time, redirected to the slurrification unit second tank. For this purpose our invention includes various configurations of chutes and screw conveyors. Our invention also includes the further treatment of the cuttings with subsequent discharge and injection into porous formations in the wellbore. The slurrification unit operation, can be performed with two isolated circulating systems, as well as, a commingled system, in which case the two slurrification unit circulation systems share either all or part of the slurried cuttings.

Furthermore, our invention improves the method of discharging the cuttings from both hoppers into a single slurrification unit tank without subsequent redirection. Prior methods, having only one hopper, required that the suction force at the shale shaker trough be terminated during the discharge of cuttings from the hopper. In our invention, this suction force can be continuous.

Our invention also includes the movement of the two hoppers for discharge, first into the slurrification unit first tank, and then to the slurrification unit second tank.

In the many configurations involving the slurrification unit, our invention also includes the step of filtering the discharge from such slurry units, catching oversized particles and recirculating them for further grinding.

Our invention includes the use of more than two hoppers, with method and apparatus variations and adaptations which correspond to analogous variations and adaptations described for two hoppers.

Our invention includes apparatus for moving drill cuttings from a cuttings collection point to one or more receptacles, which comprises a first and second hopper, each hopper having a cuttings inlet, an air outlet, and a cuttings discharge outlet, a common suction line having a first end and a second end, a first independent suction line and a second independent suction line, the first independent suction line being in suction communication with the first hopper cuttings inlet and a common suction line second end, the second end suction line being in suction communication with the second hopper cuttings inlet and the common suction line second end, suction force means (or suction force introduction means), a common exit line, having a first and a second end, the common exit line first end being in suction communication with the suction force means such that the suction force means creates a suction force in the common exit line, a first independent exit line and a second independent exit line, the first independent exit line being in suction communication with the common exit line second end and the first hopper air outlet, the second independent exit line being in suction communication with the common exit line second end and the second hopper air outlet, suction alternating means such that the suction force means repeatedly creates a suction force in one of the first or second hoppers, then the other of the first or second hoppers, but in only one of such hoppers at any one instant, the suction force drawing drill cuttings through the common suction line first end, when the common suction line first end is placed in proximity to drill cuttings in the cuttings collection point, and a first hopper discharge valve and a second hopper discharge valve for allowing cuttings to be respectively discharged from the first and second hoppers during intervals in which no suction force is present in the discharging hopper.

Our invention also includes such apparatus wherein the first hopper discharge valve, the second hopper discharge valve, and the suction alternating means are coordinated such that the opening of the first hopper discharge valve and the termination of the suction force in the first hopper begin simultaneously, or substantially simultaneously, and the opening of the second hopper discharge valve and the termination of the suction force in the second hopper begin simultaneously, or substantially simultaneously.

Preferred embodiments of our invention include the configuration of the suction alternating means such that the suction force is continuously present in either the first or second hopper; or, in another embodiment, that the suction force is continuously present at the cuttings collection point, i.e. at the common suction line first end.

In a preferred embodiment of our invention, the suction alternating means includes a diverter valve positioned on the common suction line such that suction communication between the common suction line and either of the first or the second independent suction lines can be broken, the diverter valve being interconnected with the first independent exit line valve, the second independent exit line valve, the first hopper discharge valve, and the second hopper discharge valve, such that, when the first independent exit line closes, the second independent exit line valve opens, the first hopper discharge valve opens, the second hopper discharge valve closes, and the diverter valve breaks suction communication with the first independent suction line, and further such that, when the first independent exit line valve opens, the second independent exit line closes, the first hopper discharge valve closes, the second hopper discharge valve opens, and the diverter valve breaks suction communication with the second independent suction line.

In another embodiment, the first independent exit line valve, the second independent exit line valve, the first hopper discharge valve, and the second hopper discharge valve are interconnected such that, when the first independent exit line closes, the second independent exit line valve opens, the first hopper discharge valve opens, and the second hopper discharge valve closes, and further such that, when the first independent exit line valve opens, the second independent exit line valve closes, the first hopper discharge valve closes, and the second hopper discharge valve opens.

In another embodiment, the suction alternating means includes a suction-operated first independent suction line valve and a suction-operated second independent suction line valve, the first independent suction line valve closing the first independent suction line when a suction force is in the second independent suction line, the second independent suction line valve closing the second independent suction line when a suction force is in the first independent suction line.

In another embodiment, the first and second hopper discharge valve, each comprised a hinged flap, hinge with respect to the hopper cuttings discharge outlets, such that the hinge flap closes the hopper cuttings discharge outlet when a suction force is present within the hopper.

Our invention also includes a vibrator for both hoppers, which causes the cuttings to discharge more freely. Similarly, one or more air jets are included for agitating and dislodging cuttings from the interior walls of the first and second hoppers. Such air jets can be postponed to effect a circumferential pattern.

A clean out access hatch is also provided for both the first and second hoppers.

Our invention also comprises a hopper guide frame, the hopper guide frame being configured to support and secure the first and second hoppers, the hopper guide frame further having one or more tracks with the first and second hoppers being movable along these tracks. The movement of the first and second hoppers may be independent.

Another embodiment of our invention includes a hopper support frame where the hopper support frame is configured to support and secure one or more hoppers, and a hopper support frame guide fixture which is sized and configured such that it supports the hopper support frame. This hopper support frame guide fixture has one or more tracks and the hopper support frame is attached to such tracks such that the hopper support frame is movable along the hopper support frame guide fixture tracks. Our invention also includes additional hopper support frames on the hopper support frame guide fixture, as well as, two or more hopper support frames on two or more hopper support frame guide fixtures. Powered movement and direction of the hoppers and the hopper support frame is also provided.

In another embodiment, longitudinally expandable first and second independent suction lines and exit lines are also included which will allow a variable space between the first and second hoppers.

In our invention, when the formation drill cuttings have collected in the shale shaker trough, a suction force is created in a common suction line having an end in such drill cuttings, the common suction line then dividing into a first independent suction line and a second independent suction line, these lines being in suction communication with a first hopper and a second hopper respectively, the first and second hoppers being in suction communication with a first independent exit line and a second independent exit line respectively, the first and second independent exit lines joining to form a common exit line which extends ultimately to a suction-creatingblower, the first and second exit lines, common exit line and blower being in suction communication. The suction force in the first hopper is removed by closing a first independent exit line valve and breaking suction communication between the first independent suction line and the common suction line. The suction force in the second hopper is initiated by opening a second independent line valve. Drill cuttings are then received from the common suction line, through the second independent suction line, into the second hopper, until the desired amount of drill cuttings are in the second hopper. The suction force is then removed from the second hopper by closing a second independent exit line valve and breaking suction communication between the second independent suction line and the common suction line. Drill cuttings are discharged from the second hopper through a second hopper discharge opening by opening a second hopper discharge opening valve. The suction force in the first hopper is initiated by opening the first independent exit line valve and restoring suction communication between the first independent suction line and the common suction line. Drill cuttings are received from the common suction line, through the first independent suction line, into the first hopper, until the desired amount of drill cuttings are in the first hopper. The suction force is removed from the first hopper by closing the first independent exit line valve and isolating the first independent suction line from the common suction line. Drill cuttings are discharged from the first hopper through a first hopper discharge opening by opening a first hopper discharge opening valve. These steps are repeated for as many cycles as necessary to accommodate the volume of drill cuttings which must be addressed.

Our invention includes, in a preferred embodiment, that the steps of closing the first independent exit line valve, breaking suction communication between the first independent suction line and the common suction line, opening the first hopper discharge opening valve, and opening the second independent exit line occur simultaneously, or substantially simultaneously, and that the steps of closing the second independent exit line valve, breaking suction communication between the second independent suction line and the common suction line, opening the second hopper discharge opening valve, and closing the first independent exit line valve occur simultaneously, or substantially simultaneously.

In another embodiment the common suction line is eliminated and the first independent suction line and the second independent suction line both extend to the cuttings collection point, i.e. the shale shaker trough.

DESCRIPTION

Figure 1:
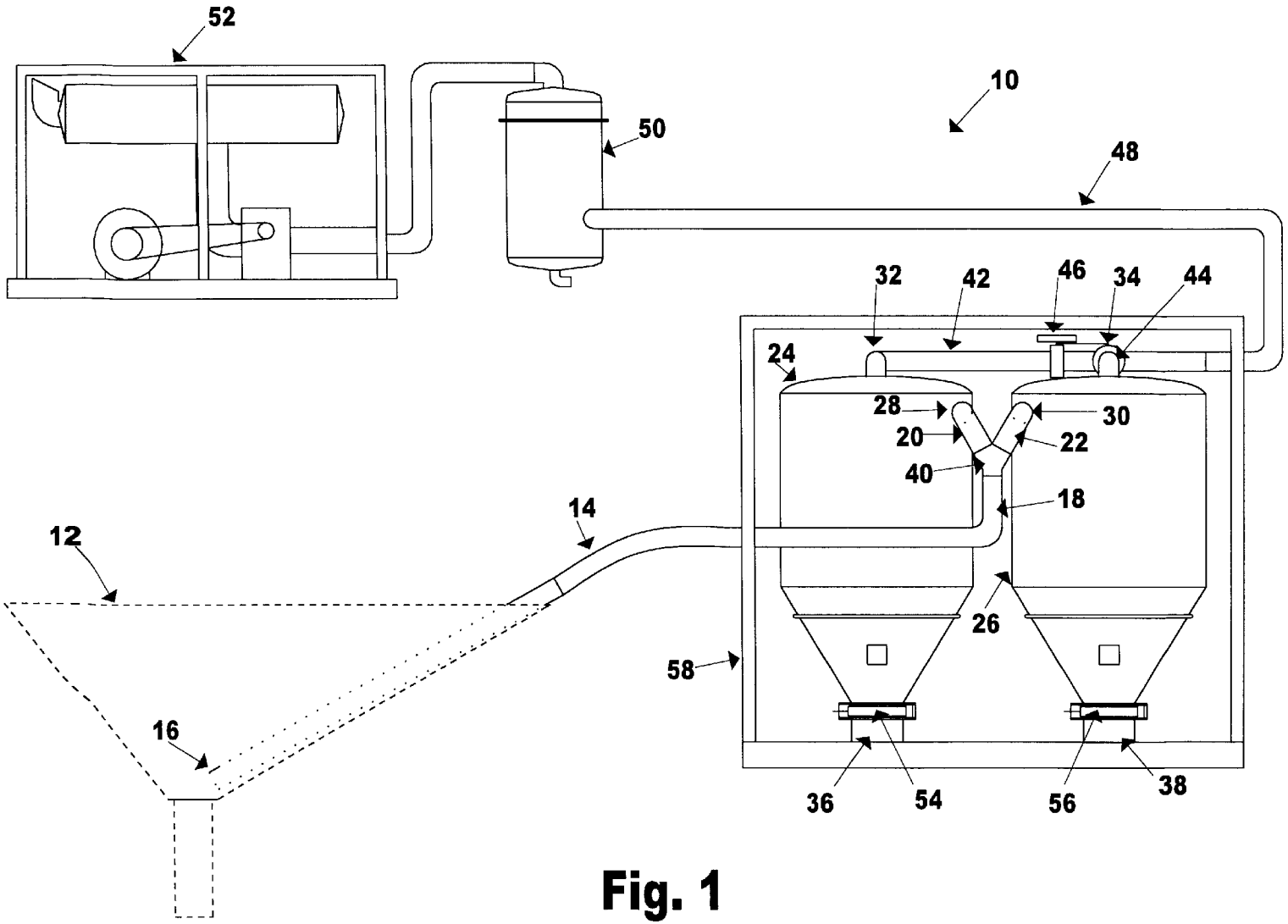
FIG. 1 is a schematic representation of the drill cuttings transfer system.

A drill cuttings transfer system 10 is depicted in FIG. 1. Drill cuttings accumulate in a cuttings collection point 12, normally the trough associated with a shale shaker. The suction force in a common suction line 14 draws the cuttings into the common suction line 14 first end 16. At the common suction line 14 second end 18, the cuttings are diverted to either of a first independent suction line 20 or a second independent suction line 22. In a preferred embodiment shown in FIG. 1, the common suction line 14 is flexible.

A first and second hopper 24,26 each have a cuttings inlet 28,30, air outlets 32,34, and cuttings discharge outlets 36,38. Air and cuttings are received into the first and second hoppers 24,26 through the cuttings inlets 28,30. Within the hopper, the cuttings are cyclonically separated. The air exits the first and second hoppers 24,26 through the air outlets 32,34, while the cuttings accumulate within the first and second hoppers 24,26 through the cuttings discharge outlets 36,38.

Figure 2:
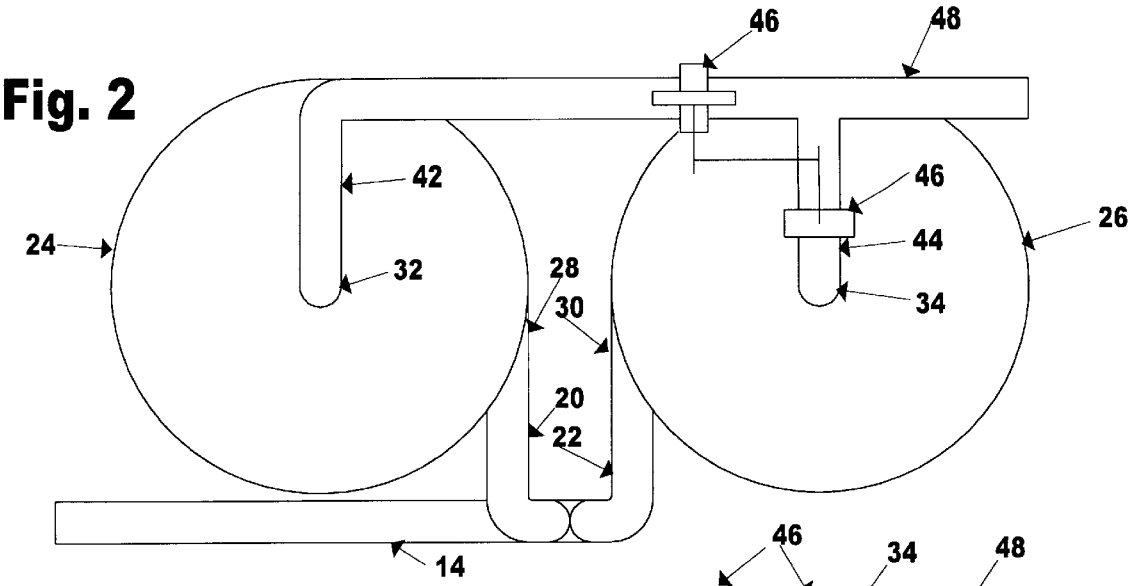
FIG. 2 is a top view of the dual hopper portion of the system.
Figure 3:
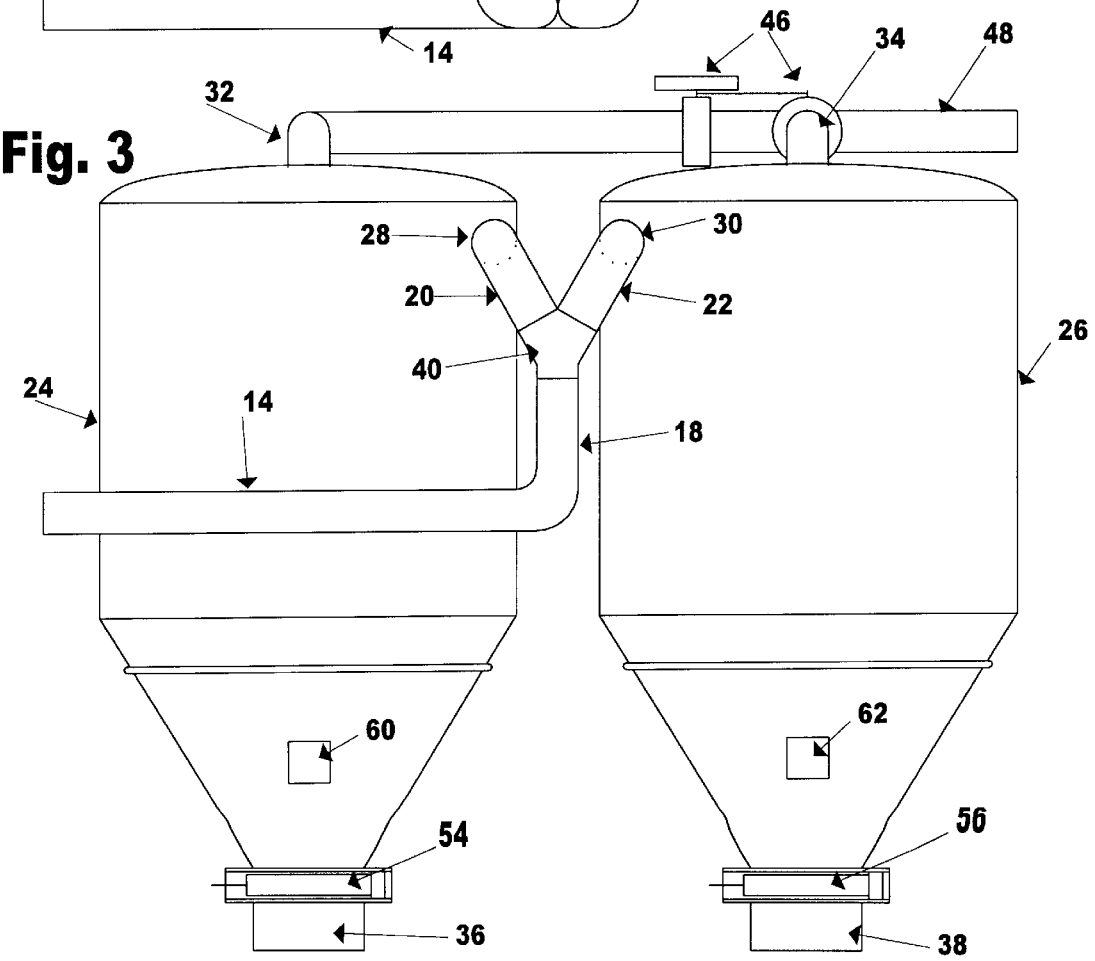
FIG. 3 is a side view of the dual hopper portion of the system.
Figure 4:
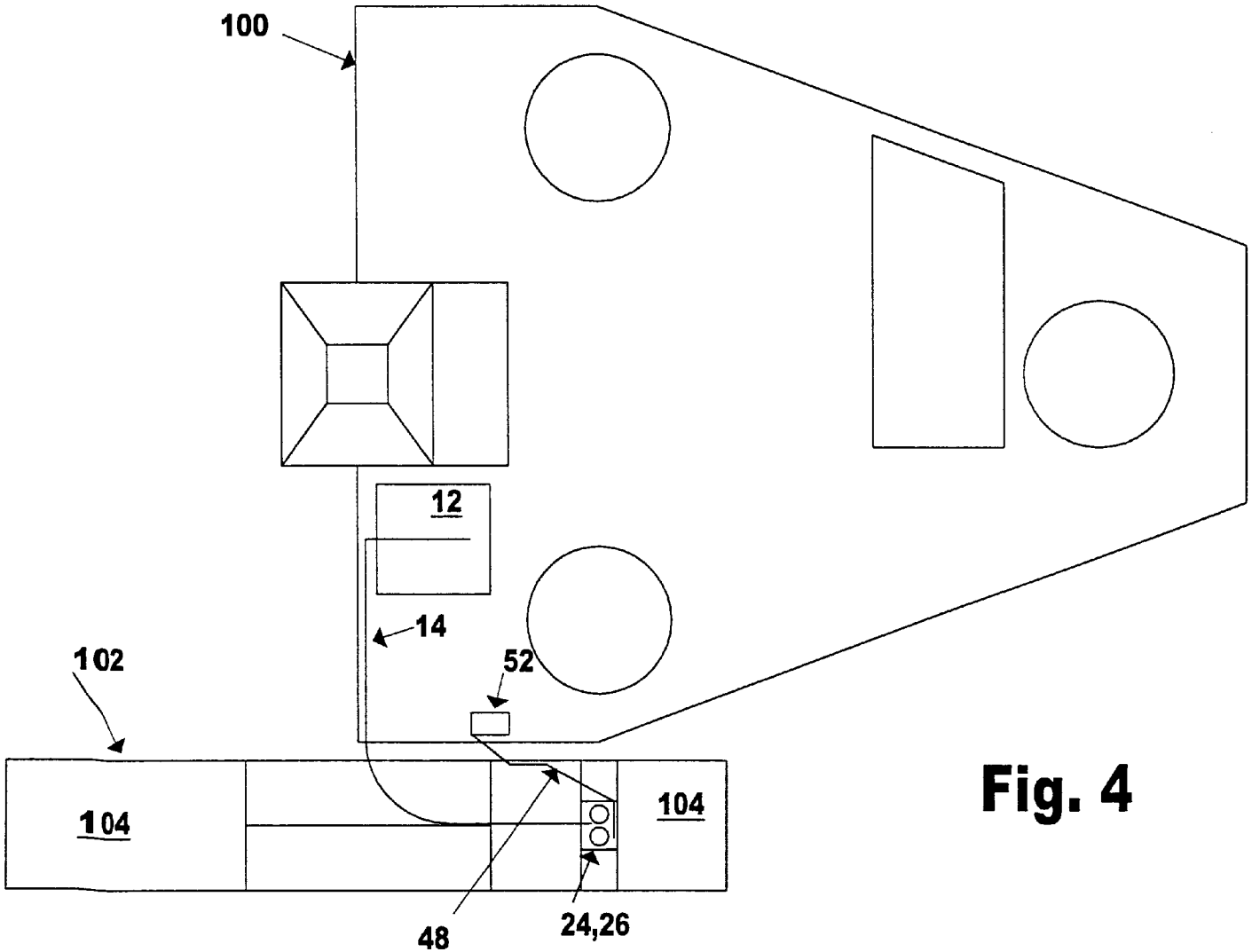
FIG. 4 is a schematic representation of an embodiment of the system in use on a jack-up rig, with a barge for a receptacle.
Figure 5:
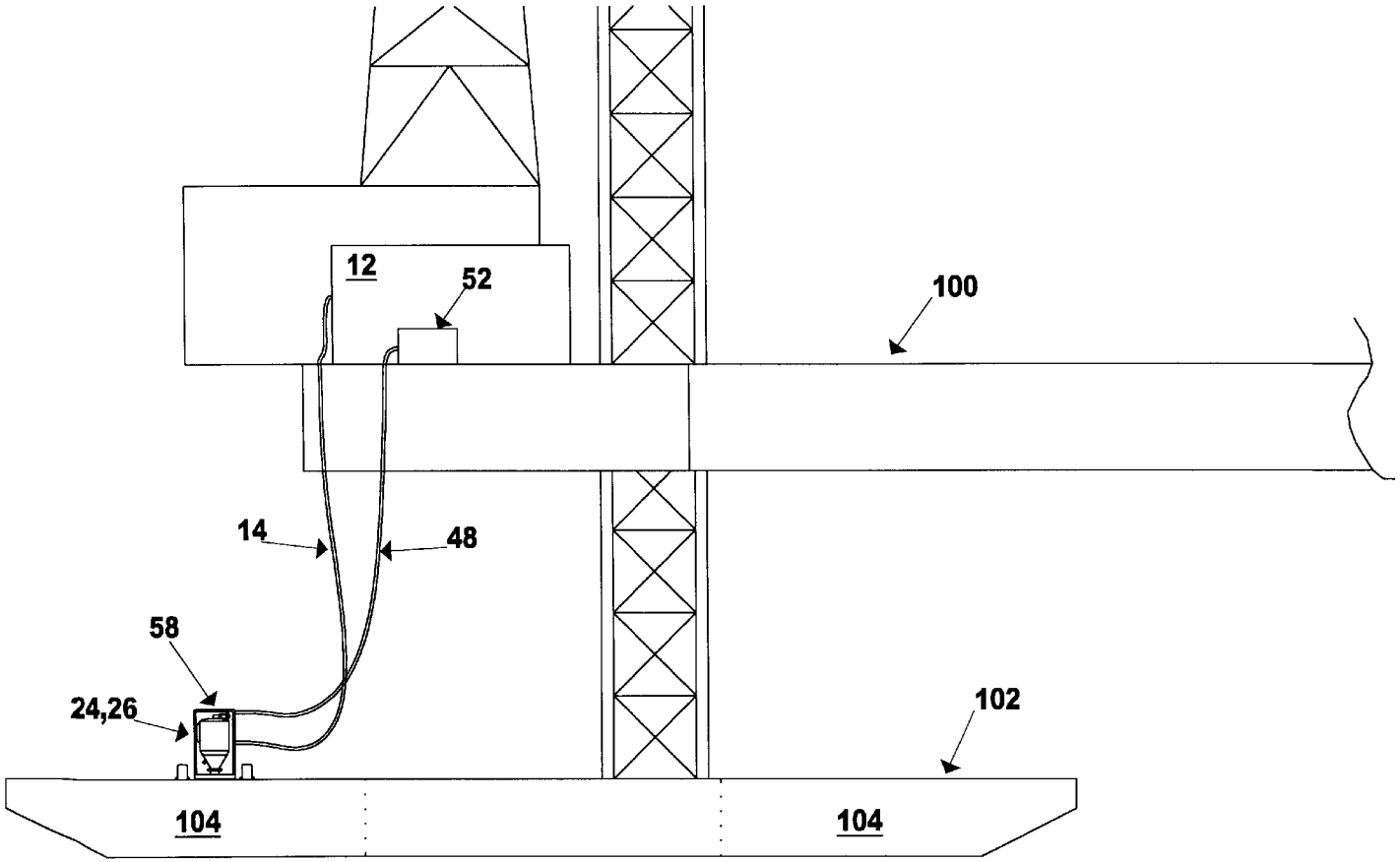
FIG. 5 is a side view of the rig and barge in FIG. 4
Figure 7:
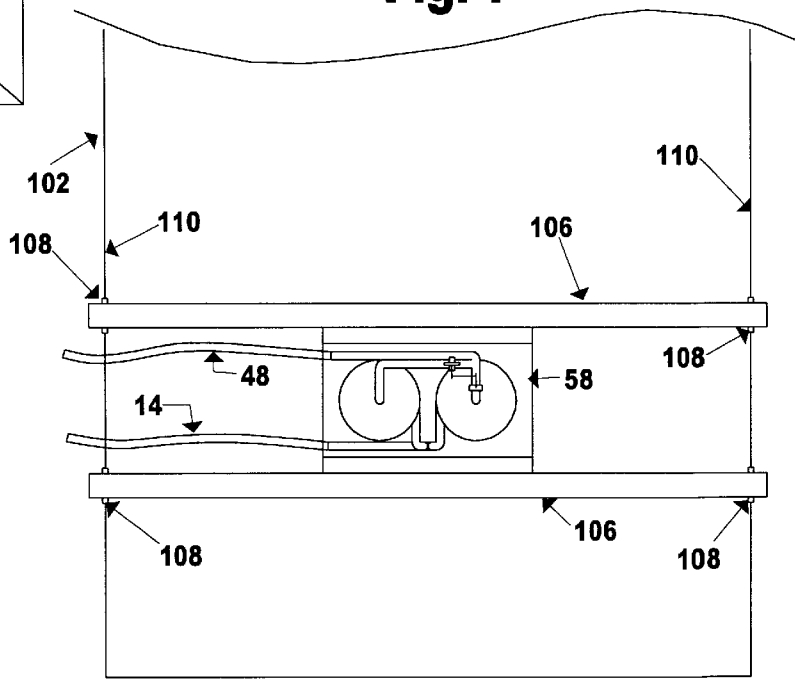
FIG. 7 is a top view of the barge with the dual hopper portion of the system in place.
Figure 6:
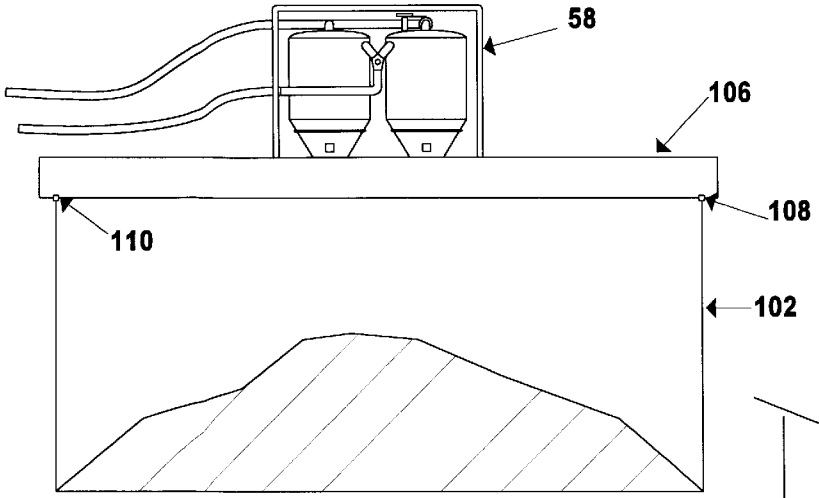
FIG. 6 is an end view of the barge with the dual hopper portion of the system in place.

The FIG. 1 embodiment includes a pneumatically operated common suction line diverter valve which allows cuttings to enter only one of the first or second independent suction lines 20,22 at a time. The DGP Pneumatic diverter valve by Bush & Wilton Valves, Inc., is a satisfactory choice to accomplish this result, although simpler combinations of flaps, check valves, and even manually operated ball valves, gate valves, etc., can also accomplish the same result. First and second independent exit lines 42,44 receive air from the air outlets 32,34, and in the embodiment depicted in FIG. 1, a pneumatically operated three-way valve 46 is situated with respect to such exit lines 42,44 such that air is being withdrawn from only one of the first and second hoppers 24,26, at a time. FIGS. 2–3 provide additional views showing the placement of the three-way valve 46 with respect to air outlets 32,34. The first and second independent exit lines 42,44 merge to form a common exit line 48. The common exit line 48, in the embodiment depicted in FIG. 1, is in suction communication with a scrubber 50 for a final separation of solids in the form of fines, from the air, prior to the air being drawn into the blower 52.

The three-way valve function an be executed by several well-known combinations of valves and actuating cylinders. In the embodiment shown in FIG. 1, they three-way valve 46 includes two butterfly valves, an actuating cylinder, pneumatic lines, and T-linkage linking the valves.

The scrubber 50 provides a vertical path for the air allowing any liquid to fall to the bottom. A scrubber outlet valve is connected to a float which closes the valve when liquids in the scrubber 50 reach a predetermined level.

It is anticipated that the blower 52 will be sized at approximately 3,000 cfm and be powered by a 125 HP electric motor. It is anticipated that the blower 52, or other suction creating devices, will be sized to form a continuous vacuum at 15 inches of mercury, and an intermittent vacuum at 22 inches of mercury. The Roots 624 RCS positive rotary lobe blower will satisfactorily perform this function.

In the embodiment depicted in FIG. 1, the accumulated cuttings in first and second hoppers 24,26 exit through cuttings discharge outlets 36,38 when such outlets 36,38 are opened using cuttings discharge outlet valves 54,56. The pneumatically operated SB Series, SBT-Pneumatic (twin cylinder) slide valve by Bush & Wilton Valves, Inc., is satisfactory for this application. The cuttings discharge is enhanced by the use of pneumatically operated vibrators 58,60 placed in the vicinity of the cuttings discharge outlets 36,38 on each of the first and second hoppers 24,26. The "MARTIN" "VIBROLLER" vibrator, Model UCVR4-.05 is satisfactory for this application.

The common exit line 48 is flexible in the embodiment depicted in FIG. 1.

The first and second hoppers 24,26 are secured by a frame 58 in the embodiment depicted in FIG. 1. This frame 58 can be shaped and configured to enable numerous configurations and applications of this system 10.

In the embodiment depicted in FIG. 1, the first and second hoppers 24,26 are generally cyclonic and can-shaped, having a cone-shaped discharge and an elliptical head.

Figure 19:
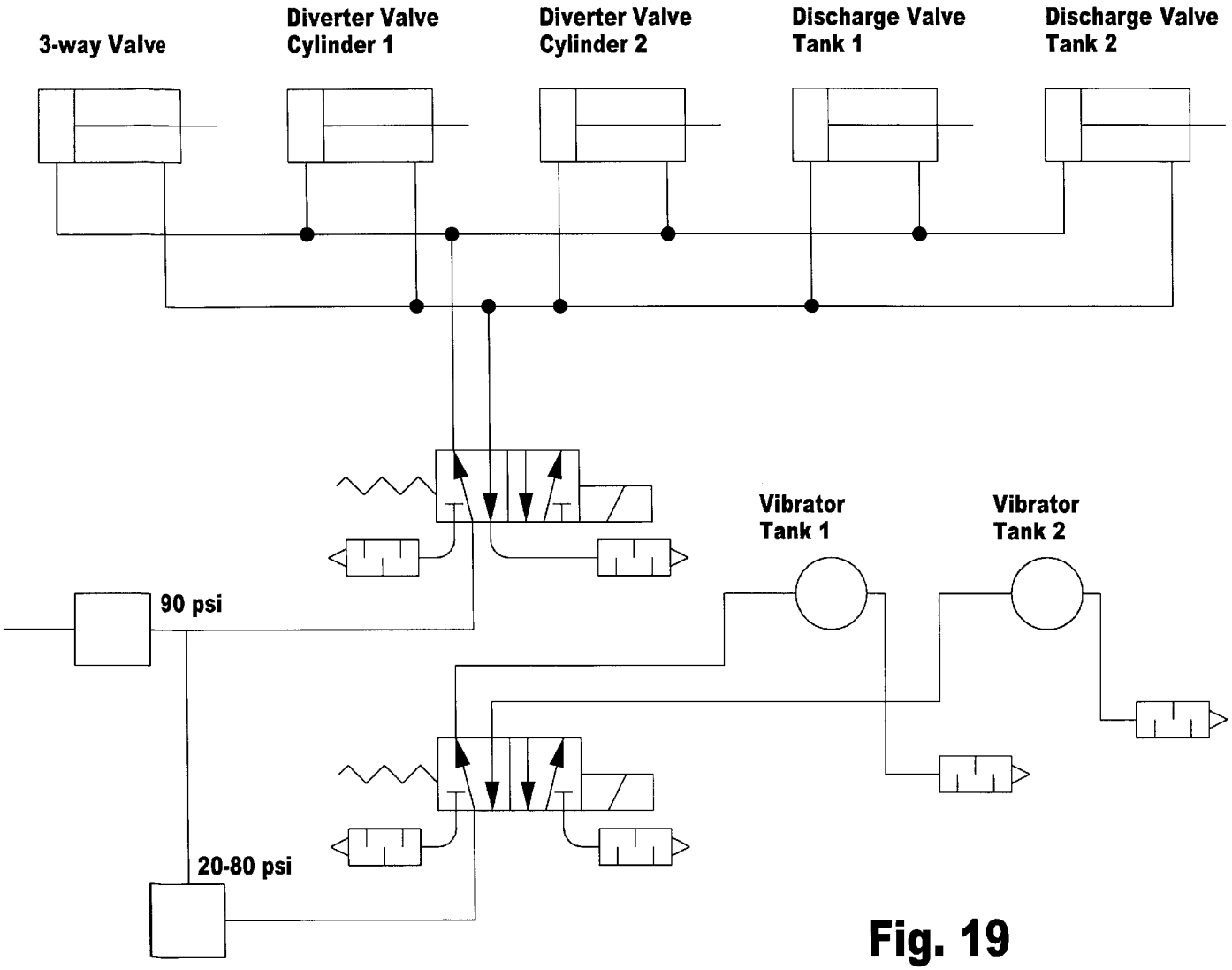
FIG. 19 is a schematic indicating the electrical and pneumatic circuits which control the valves and vibrators in the dual hopper portion of the system.

A timer, or manual operation, can be utilized to coordinate the operation of the three-way valve 46, the cuttings discharge outlet valves 54,56 and the common suction line diverter valve 40 in a manner such that the suction force is continuously present in either the first or the second hopper 24,26 continuously present at the cuttings collection point 12, and at the required openings and closings of such valves 40,46,54,56 occur simultaneously, or substantially simultaneously. A preferred embodiment is shown in the FIG. 19 schematic in which the valves 40,46,54,56 are coordinated such that the system 10 is in one of two modes of operation, at all times, but not simultaneously. In the first mode, the common suction line diverter valve 40 opens the first independent suction line 20 and closes the second independent suction line 22, the three-way valve 46 opens the first independent exit line 42 and closes the second independent exit line 44, the first hopper cuttings discharge outlet valve 54 is closed and the second hopper cuttings discharge outlet valve 56 is open. In this first mode, cuttings are being drawn through the first independent suction line 20 into the first hopper 24, where they accumulate as the air exits through the first independent exit line 42. Any cuttings in the second hopper 26 will fall, or will have fallen, through the open second hopper cuttings discharge outlet 38.

In the second mode, the common suction line diverter valve 40 closes the first independent suction line 20 and opens the second independent suction line 22, the three-way valve 46 closes the first independent exit line 42 and opens the second independent exit line 44, the first hopper cuttings discharge outlet valve 54 is open and the second hopper cuttings discharge outlet valve 56 is closed. In this second mode, cuttings are being drawn through the second independent suction line 22 into the second hopper 26, where they accumulate as the air exits through the second independent exit line 44. Any cuttings in the first hopper 24 will fall, or will have fallen, through the open first hopper cuttings discharge outlet 36.

Although most embodiments are readily adaptable to interconnected and fully automated valve combinations, it is also contemplated within our invention, that manual operation of some or all of the valves is feasible.

Figure 10:
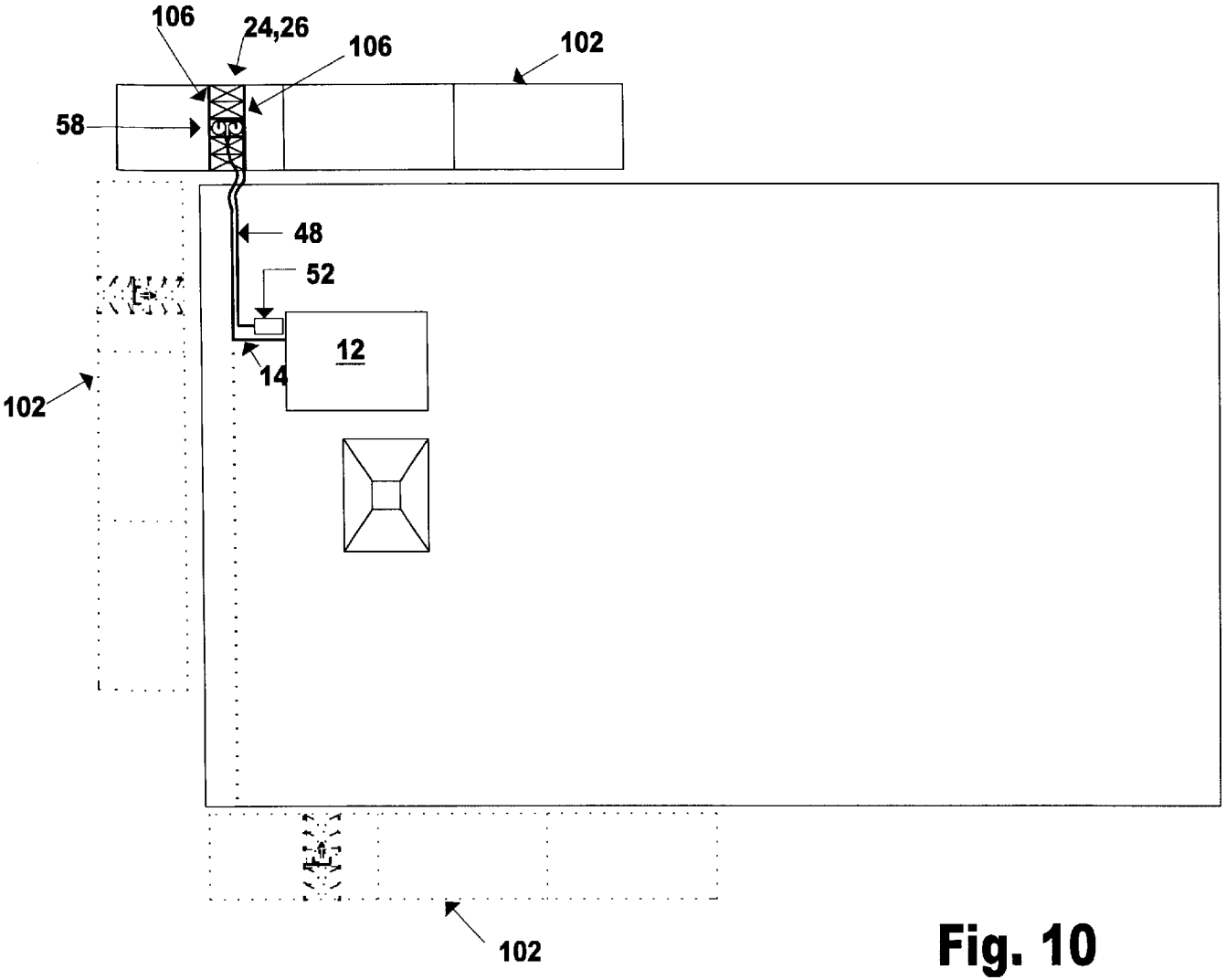
FIG. 10 is a top view schematic representation of an embodiment of the invention utilized on an offshore rig, with several barges in position to be serviced.

The drill cuttings transfer system 10 is readily adaptable to numerous applications in both the onshore and offshore drilling environments. FIGS. 4–7 depict various views of an offshore drilling environment involving a jack-up rig 100, a barge 102, and several compartments 104 for storing cuttings on the barge 102, the compartments 104 being open-topped. Symbolic representations of certain components of the system 10 are also depicted. In this preferred embodiment, the hopper frame 58 is positioned on cross members 106 which span the width of the barge 102, the cross members 106 having rollers 108, the rollers 108 being situated along tracks 110, such that the cross members 106 can move along the length of the barge 102. In other embodiments, it is also contemplated that a similar roller and track arrangement could be provided to allow lateral movement of the frame 58 with respect to the length of the barge 102. In all cases, a variety of common devices could be utilized to power the movement of the hoppers 24,26 with respect to the barge 102, with remote control operation included. Freestanding diesel motors, electric motors, and other power sources can be readily adapted through ordinary automotive coupling arrangements. The frame 58, or the cross member 106 and frame 58 combination, can be placed and removed by a crane. FIG. 10 is an example of the adaptability of the system 10 to a multi-barge 102 situation, where the barges can be conveniently placed adjacent the rig 100 and still be filled due to the flexibility of the system 10. FIG. 10 also depicts variations contemplated with respect to the position of the frame 58, the cross members 106, and the barge 102.

Figure 8:
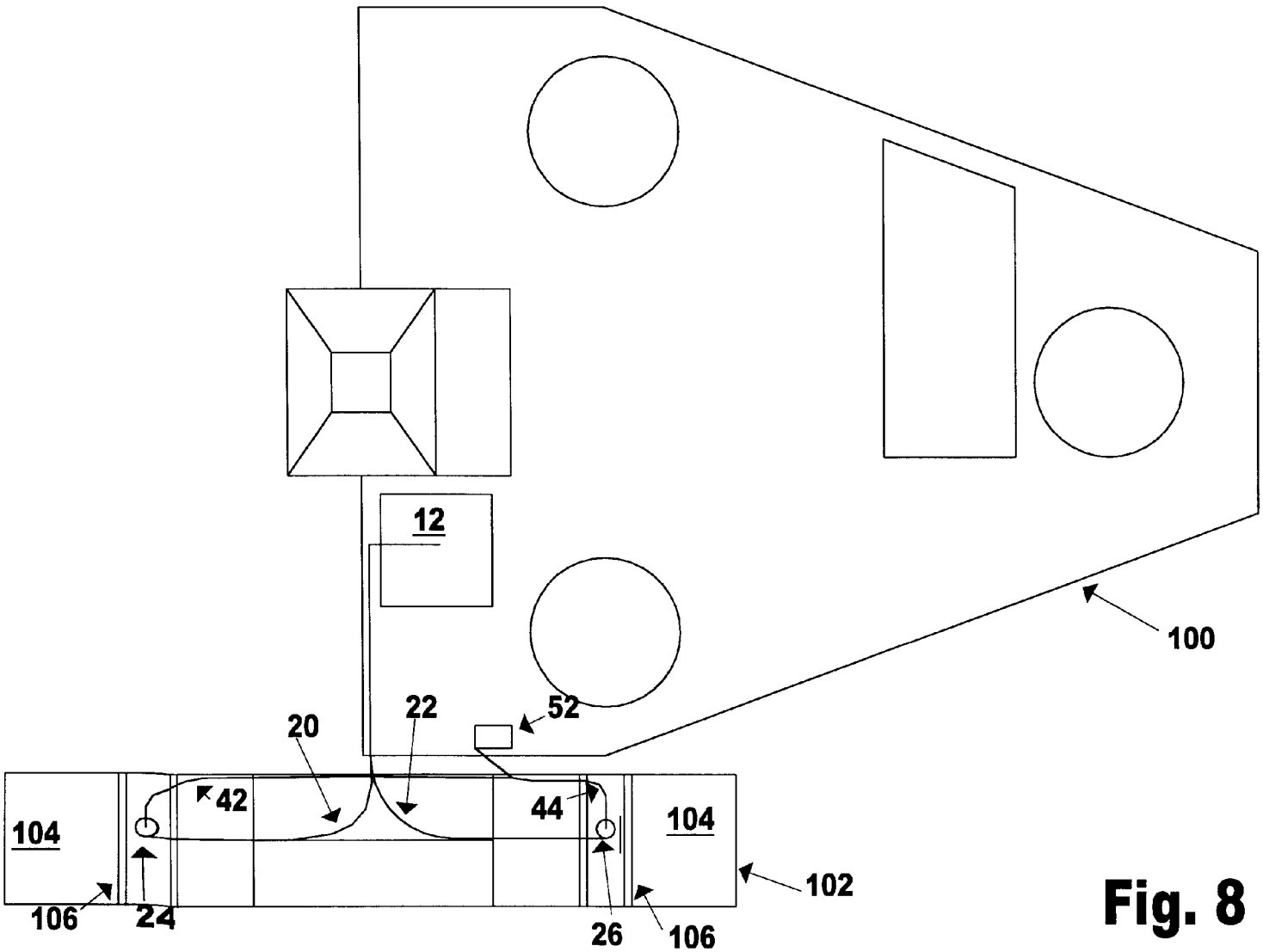
FIG. 8 is a schematic representation of an embodiment of the invention where the system is utilized on a jack-up rig with a barge.
Figure 9:
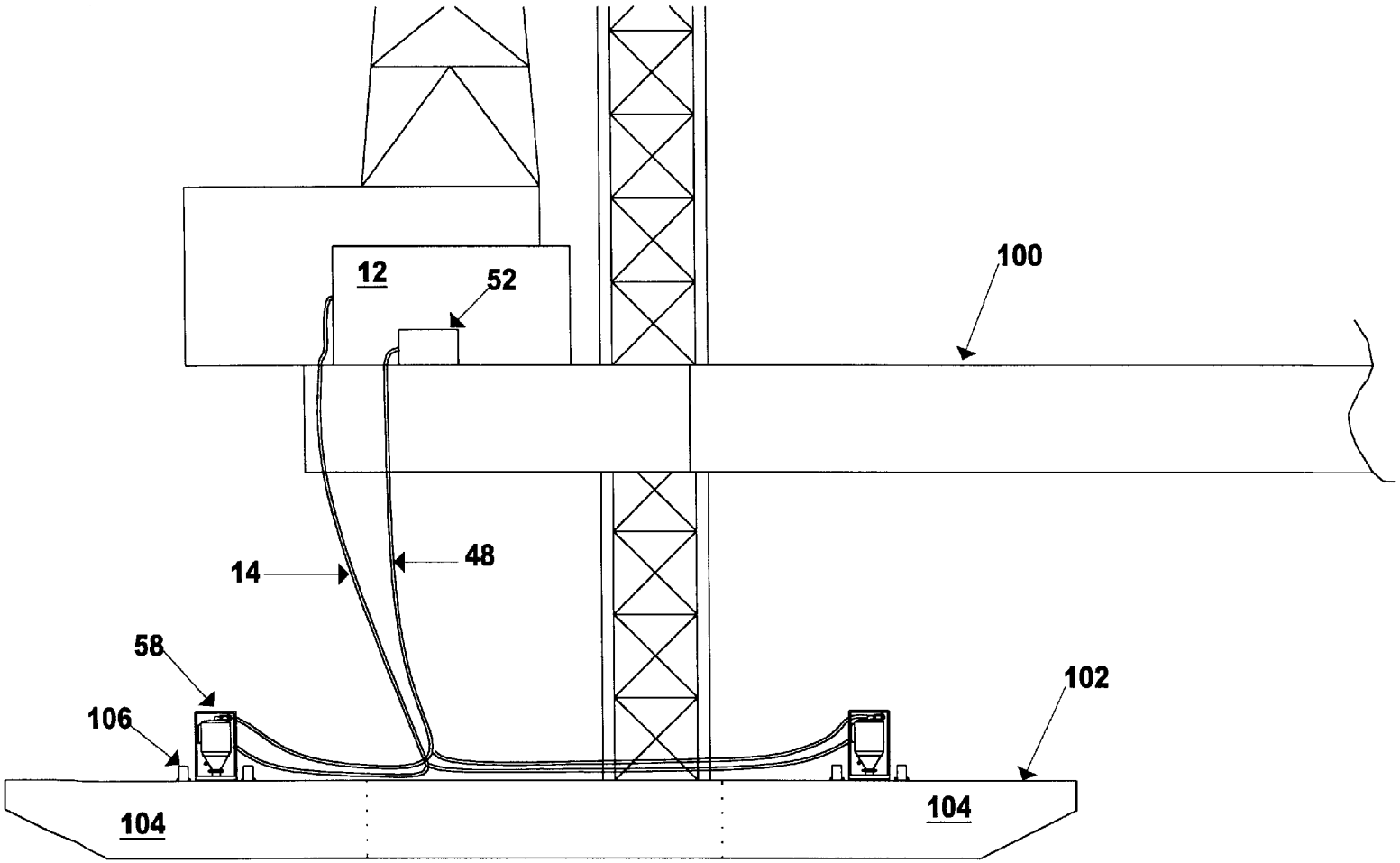
FIG. 9 is a side view of the rig and barge in FIG. 8.

FIGS. 8–9 depict embodiments of the invention in which the first and second hoppers 24,26 are independently movable along the tracks 110 in a barge 102 application.

Figure 11:
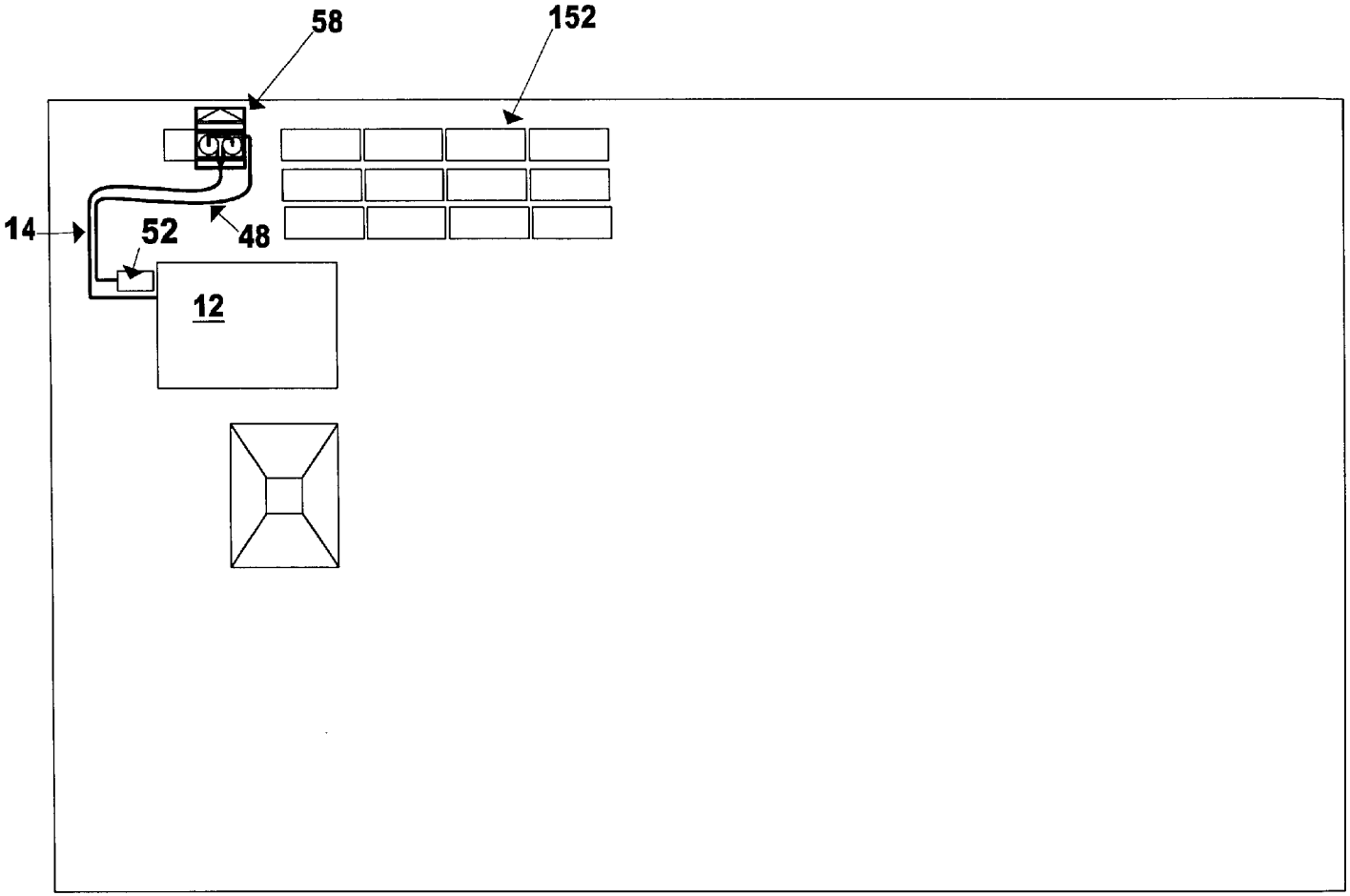
FIG. 11 is a top view schematic representation of an on rig utilization of the system, with containers depicted.
Figure 12:
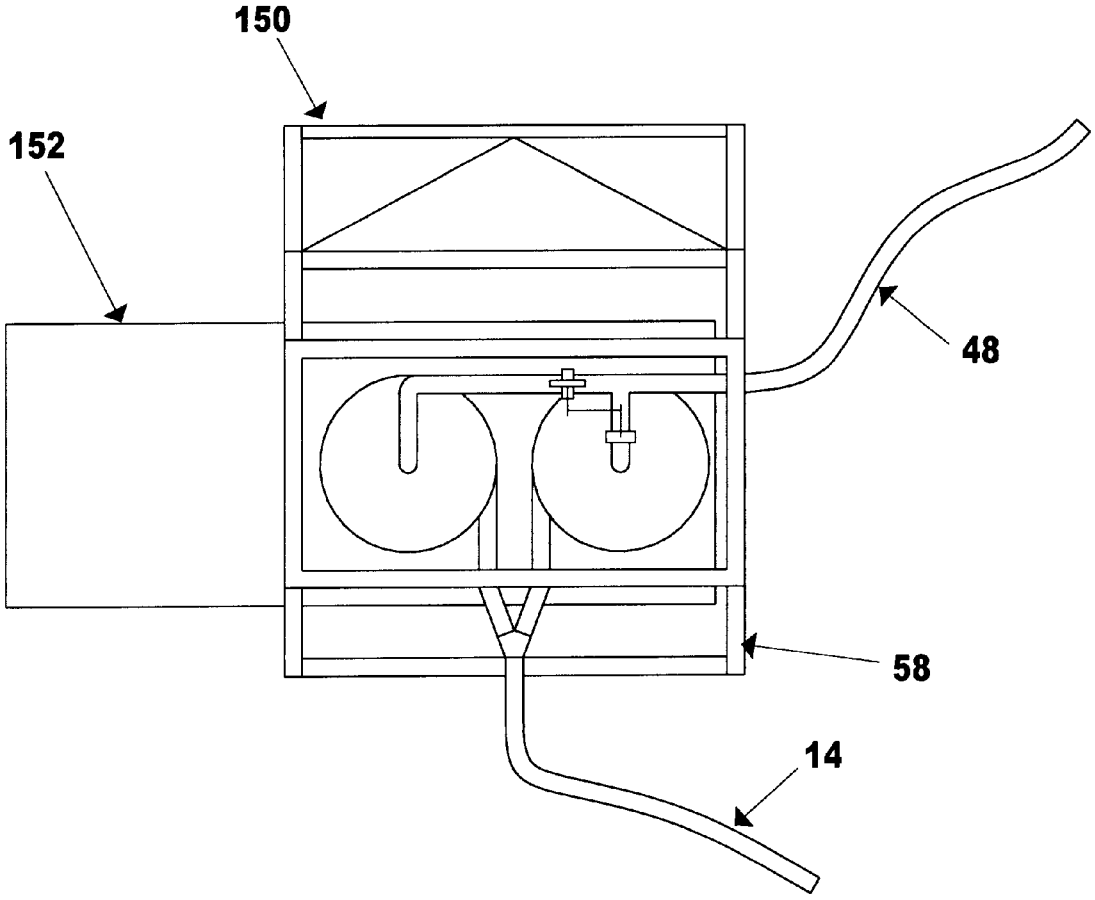
FIG. 12 is a top view of the dual hopper portion of the system with the related structure for servicing the containers in FIG. 11.
Figure 13:
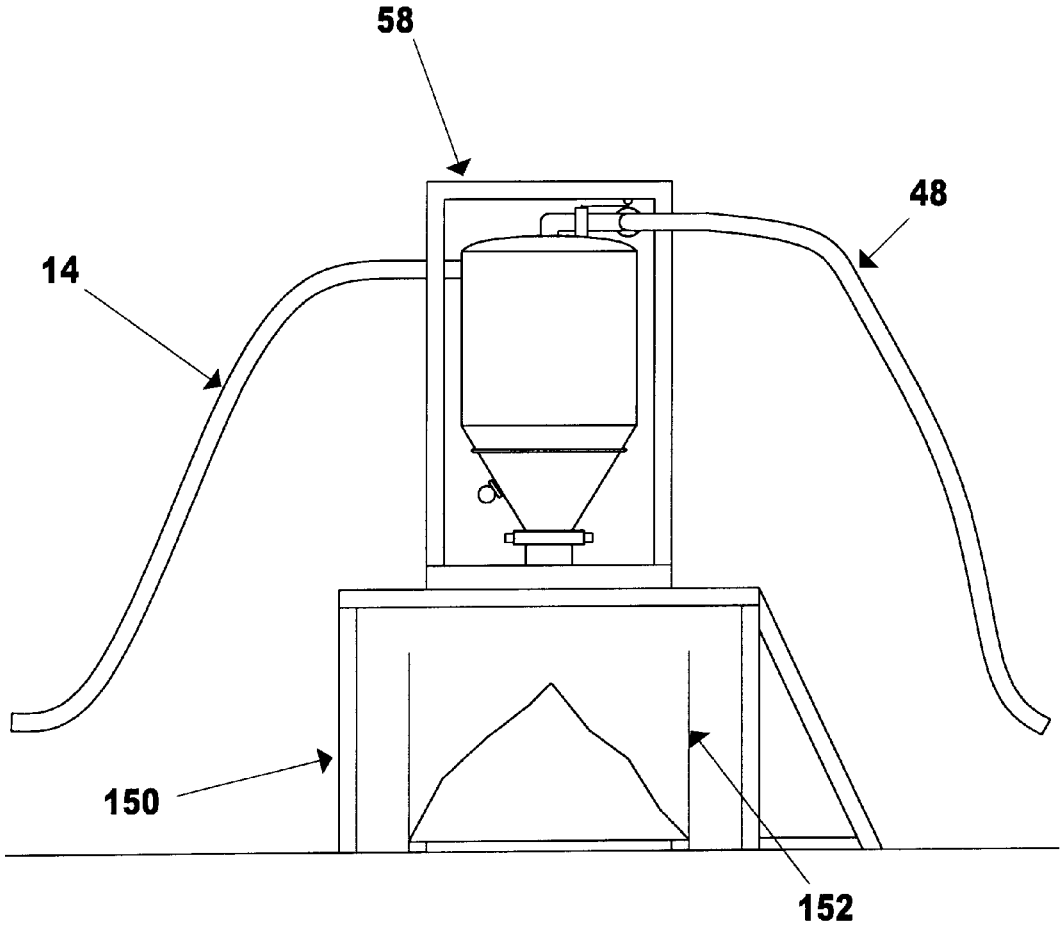
FIG. 13 is a side view of the application depicted in FIG. 13.

FIGS. 11–13 depict an additional embodiment in which the system 10 fills containers on the rig surface in an offshore drilling environment. In this embodiment, the frame 58 is placed upon a elevated structure which allows containers 152 to be moved to a position beneath the frame 58 such that the cuttings can be discharged into the containers 152. The containers 152 can be skidded or rolled into appropriate positions beneath the structure 150 and the frame 58 to enable an efficient distribution of the cuttings within the container 152. The containers 152 can be of the type with open tops, sliding door tops, etc. When removed from the other end of the structure 150 the containers 152 can be removed by a crane.

Figure 14:
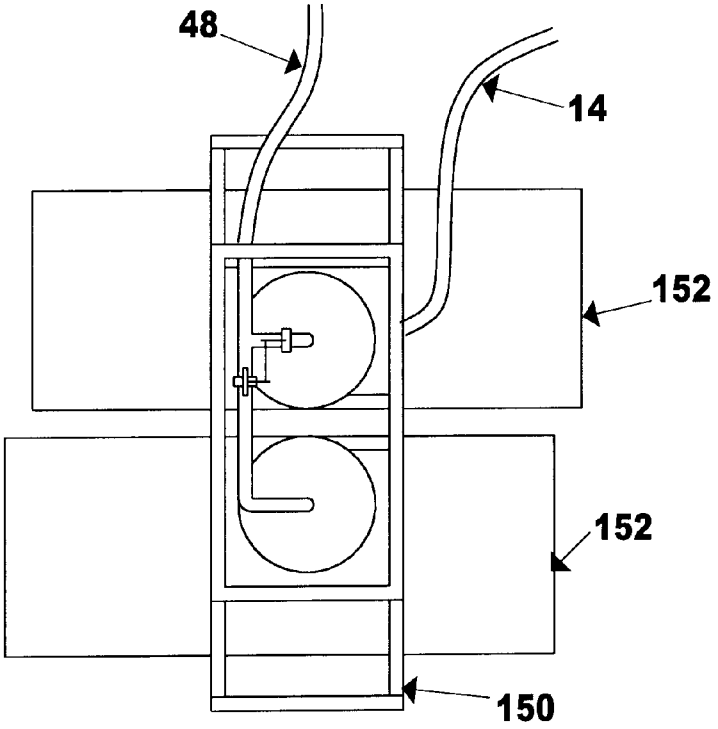
FIG. 14 is a top view schematic representation of the on rig utilization of the system in FIG. 11, with the equipment reoriented in order to fill two containers simultaneously.
Figure 15:
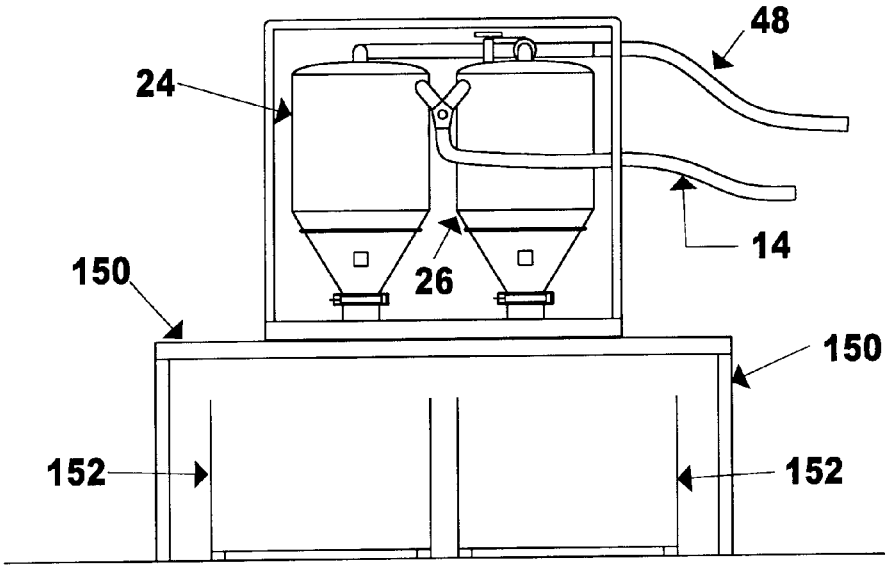
FIG. 15 is a side view of the application in FIG. 14.

FIGS. 14–15 depict an embodiment of the invention in which the frame 58 and structure 150 are oriented such that two containers 152 can be positioned beneath the structure 150, each container 152 being filled by a different hopper 24,26.

Figure 16:
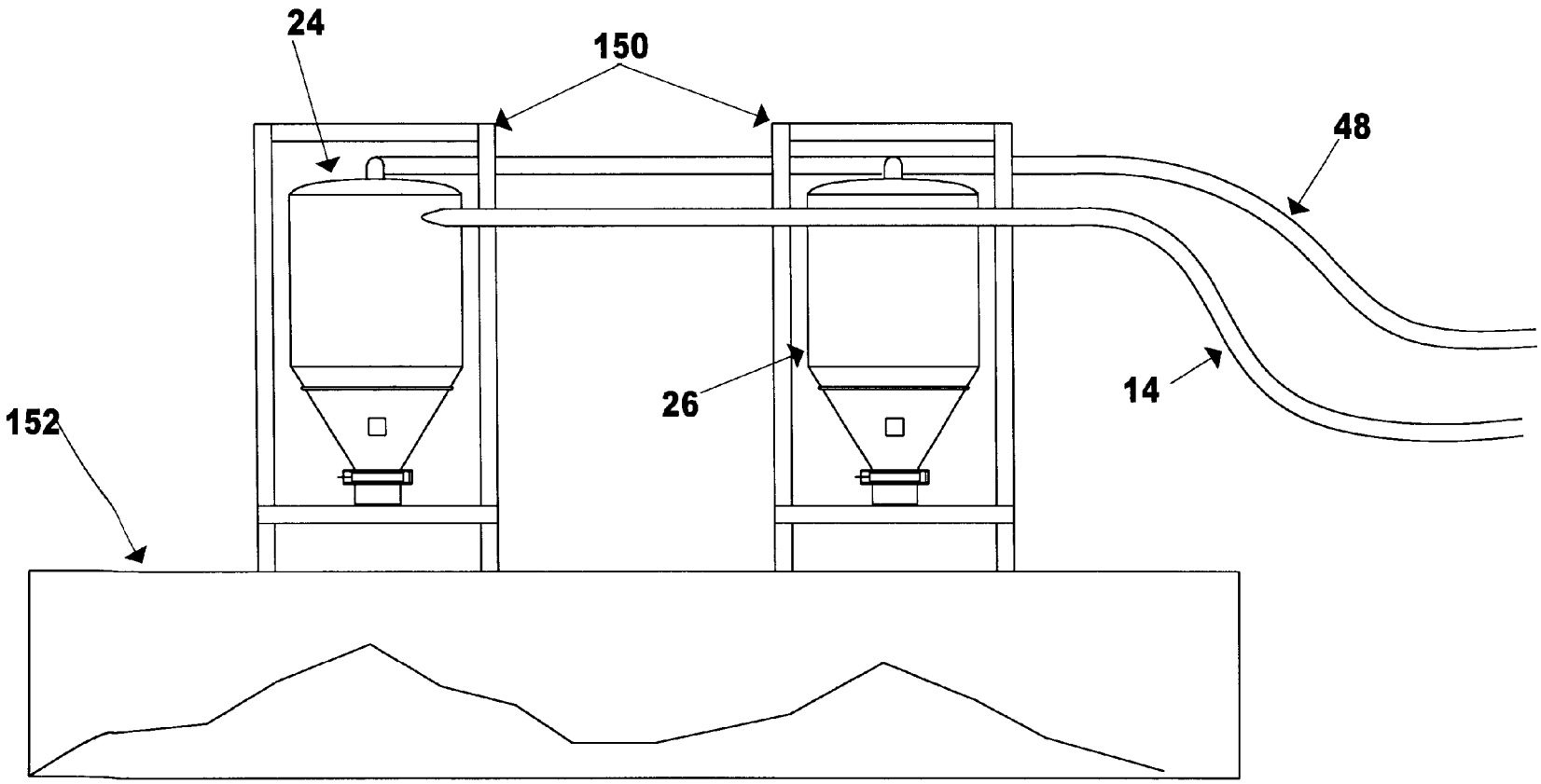
FIG. 16 is a side view schematic representation of an embodiment of the invention in which the structure allows movement of the hoppers with respect to each other.

FIG. 16 depicts an embodiment of the invention in which the first and second hoppers 24,26 can be moved with respect to each other, the variable spacing of the hoppers 24,26 allowing optimum distribution of the cuttings within a container 152.

Figure 17:
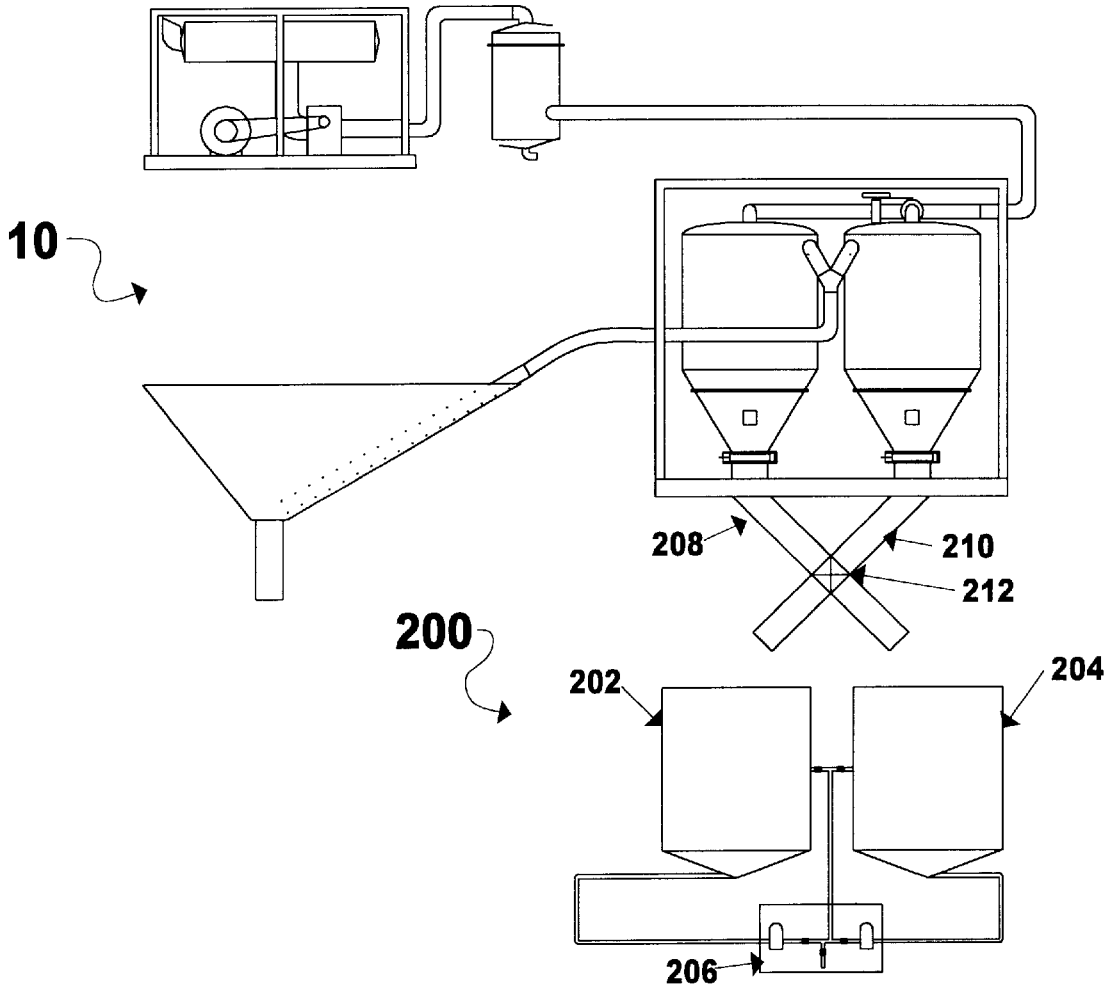
FIG. 17 is a schematic representation of an embodiment of the invention in which two tanks of a slurrification unit receive cuttings from the dual hopper portion of the system.
Figure 18:
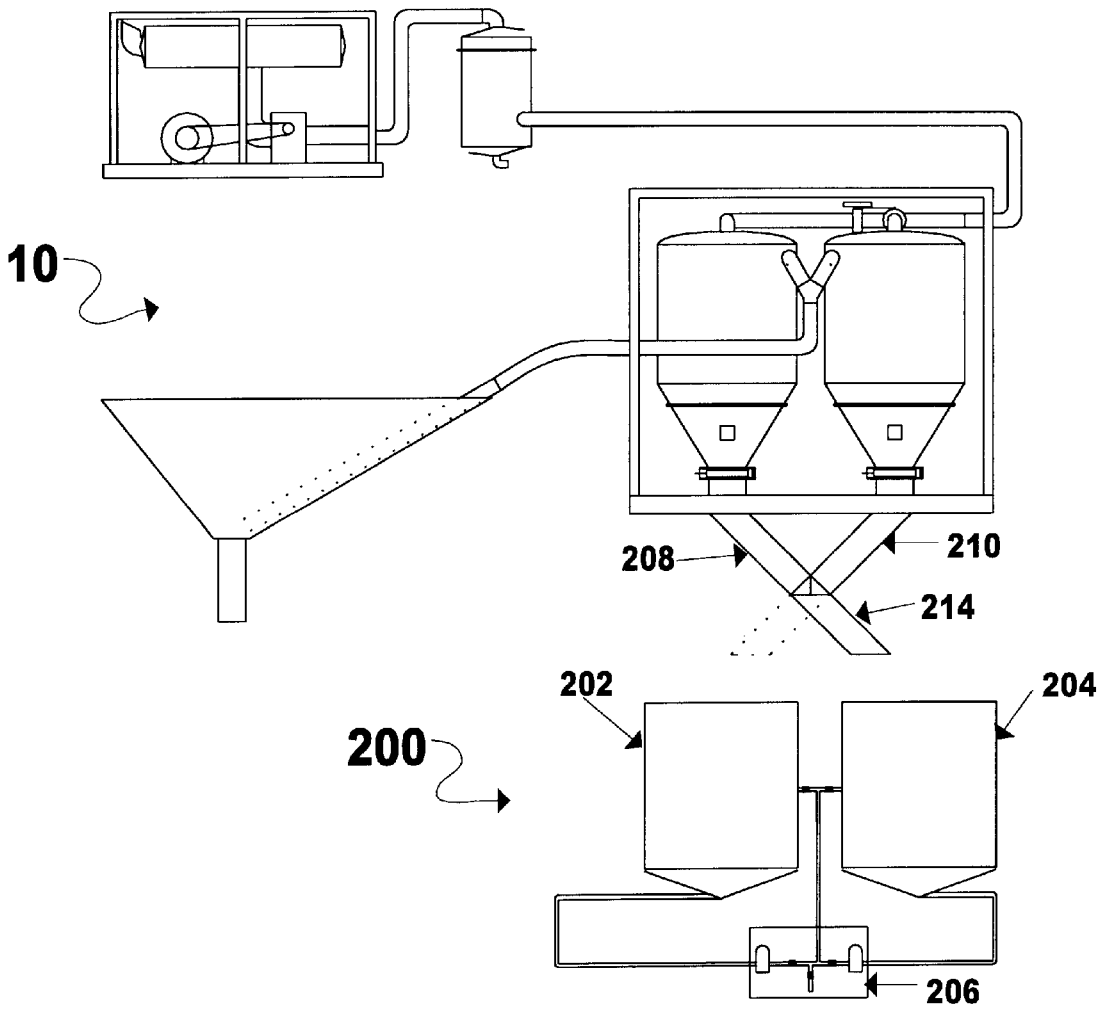
FIG. 18 is a schematic representation of an embodiment of the invention in which two tanks of a slurrification unit receive cuttings from the dual hopper portion of the system.

FIGS. 17–18 depict embodiments whereby the system 10 is coordinated with a two-tank slurrification unit 200. Slurry units 200 receive cuttings into one or more tanks 202,204 form a slurry using a liquid, usually salt water, circulating the slurry, and grinding the cuttings in the slurry during the circulation process. The slurry containing the appropriately ground cuttings is discharged from the slurrification unit 200 for disposal into the wellbore for injection into an appropriate subsurface formation. One or more holding tanks 206 usually receive the slurry in preparation for injection pumping.

In a slurrification unit 200 application, FIG. 17 depicts the discharge chutes 208,210 which receive cuttings from the first and second hopper cuttings discharge outlets 36,38. A cuttings discharge chute diverter 212 diverts the cuttings to either or both of the slurrification unit tanks 202,204. FIG. 18 depicts the application whereby the cuttings discharge chutes 208,210 direct the cuttings to a common articulated chute 214, the common articulated chute 214 being positioned to direct the cuttings to either of the slurrification unit tanks 202,204.

In another embodiment, both the first and second hoppers 24,26 can be positioned to discharge directly into only one of the slurrification unit tanks 202,204. Similarly, in another embodiment, both the first and second hoppers 24,26 discharge cuttings into either one of the slurrification unit tanks 202,204, or a screw conveyor apparatus for directing all or part of the cuttings to the other slurrification unit tank 202,204.

The reader's attention is directed to all papers and documents which are filed concurrently with or previous to this specification, in connection with this application, and which are open to public inspection with this specification. The contents of all such papers and documents are incorporated herein by reference.

Although the present invention has been described in considerable detail with reference to certain preferred and alternate embodiments thereof, other embodiments are possible. Accordingly, the spirit and scope of the claims should not be limited to the description of the embodiments contained herein.

We claim:

1. A method of moving drill cuttings from a cuttings collection point for discharge into one or more receptacles, comprising:

(a) Alternately suctioning the cuttings from the cuttings collection point to a first hopper, then a second hopper;

(b) Alternately breaking suction within the first hopper, then the second hopper;

(c) Alternately discharging the cuttings from the first hopper, then the second hopper;

(d) Receiving the discharged cuttings from the first and second hoppers into one or more receptacles; and (e) Timing steps (a)–(c) such that the second hopper is receiving cuttings while the first hopper discharges cuttings, and the first hopper is receiving cuttings while the second hopper discharges cuttings.

2. The method of claim 1, wherein the cuttings collection point is a trough in which drill cuttings accumulate from the shale shaker.

3. The method of claim 1, wherein the timing step further comprises the step of:

(a) timing steps (a)–(c) of claim 1, such that the suctioning force is continuously present in either the first or second hopper.

4. The method of claim 1, wherein the timing step further comprises the step of:

(a) timing steps (a)–(c) of claim 1, such that the suctioning force is continuously present at the cuttings collection point.

5. The method of claim 1, wherein:

(a) the steps of suctioning cuttings to the first hopper, breaking suction in the second hopper, and discharging cuttings from the second hopper begin simultaneously; and (b) the steps of suctioning cuttings to the second hopper, breaking suction in the first hopper, and discharging cuttings from the first hopper begin simultaneously.

6. The method of claim 1, wherein:

(a) the steps of suctioning cuttings to the first hopper, breaking suction in the second hopper, and discharging cuttings from the second hopper begin substantially simultaneously; and (b) the steps of suctioning cuttings to the second hopper, breaking suction in the first hopper, and discharging cuttings from the first hopper begin substantially simultaneously.

7. The method of claim 1, wherein the discharged cuttings are received into a plurality of receptacles.

8. The method of claim 1, further comprising the step of agitating and dislodging cuttings in the hoppers by the use of vibrators.

9. The method of claim 1, further comprising the steps of:

(a) receiving the discharged drill cuttings from the first hopper into a first receptacle; and (b) receiving the discharged drill cuttings from the second hopper into a second receptacle.

10. The method of claim 1, further comprising the steps of agitating and dislodging cuttings in the hoppers by the use of air jets.

11. The method of claim 1, wherein the step of receiving discharged drill cuttings from the first and second hoppers further comprises the steps of:

(a) sequentially receiving the discharged drill cuttings into a plurality of receptacles;

(b) removing each receptacle after it has been filled to the desired amount with drill cuttings;

(c) replacing each removed receptacle with another receptacle; and (d) timing steps (b)–(c) such that discharges occur only when one of the receptacles is in position to receive the drill cuttings.

12. The method of claim 1, wherein the step of receiving discharged drill cuttings from the first and second hoppers further comprises the steps of:

(a) sequentially receiving the discharged drill cuttings from the first hopper into a plurality of first hopper receptacles;

(b) removing each first hopper receptacle after it has been filled to the desired amount with drill cuttings;

(c) replacing each removed first hopper receptacle with another first hopper receptacle;

(d) sequentially receiving the discharged drill cuttings from the second hopper into a plurality of second hopper receptacles;

(e) removing each second hopper receptacle after it has been filled to the desired amount with drill cuttings;

(f) replacing each removed second hopper receptacle with another second hopper receptacle;

(g) timing steps (b)–(c) such that discharges from the first hopper occur only when one of the first hopper receptacles is in position to receive the drill cuttings; and (h) timing steps (e)–(f) such that discharges from the second hopper occur only when one of the second hopper receptacles is in position to receive the drill cuttings.

13. The method of claim 1, wherein the step of receiving discharged drill cuttings from the first and second hoppers further comprises the steps of:

(a) Moving the hoppers from a first discharge location to a second discharge location;

(b) Receiving discharge cuttings into a "second discharge location" receptacle until the desired amount of cuttings have been received therein;

(c) Replacing the "second discharge location" receptacle with another receptacle;

(d) Moving the hoppers from the second discharge location to the first discharge location;

(e) Receiving discharge cuttings into a "first discharge location" receptacle until the desired amount of cuttings have been received therein;

(f) Replacing the "first discharge location" receptacle with another receptacle;

(g) Timing all movements of the hoppers such that no cuttings discharge occurs until the hoppers are positioned for discharge into one of the receptacles; and (h) Repeating steps (a)–(f) for as many cycles as necessary.

14. The method of claim 1, further comprising the step of:

(a) spacing the first and second hoppers, with respect to their physical proximity to each other, such that the discharged drill cuttings are evenly distributed in a receptacle.

15. The method of claim 1, further comprising the step of positioning the first and second hoppers off the drilling rig prior to receiving the drill cuttings into the first and second hoppers.

16. The method of claim 1, further comprising the steps of (a) routing the discharged drill cuttings to a slurrification unit having a first and a second tank;

(b) forming a slurry consisting of the received drill cuttings and a liquid in the first tank;

(c) circulating the first tank slurry;

(d) grinding the drill cuttings in the first tank slurry while circulating;

(e) discharging the first tank slurry;

(f) receiving the discharged first tank slurry in one or more holding receptacles;

(g) forming a slurry consisting of the received drill cuttings and a liquid in the second tank;

(h) circulating the second tank slurry;

(i) grinding the drill cuttings in the second tank slurry while circulating;

(j) discharging the second tank slurry;

(k) receiving the discharged second tank slurry in one or more holding receptacles; and (l) injecting the held first and second tank slurries into a porous formation via a wellbore.

17. The method of claim 16 further comprising the step of isolating the first tank slurry from the second tank slurry, until after final discharge from their respective tanks.

18. The method of claim 16 further comprising the step of commingling all or portions of the first tank slurry and the second tank slurry during circulation.

19. The method of claim 16 further comprising the steps of:

(a) filtering all or part of the discharged slurries before receipt by the holding receptacle; and (b) routing filtered solids back to either or both of the first and second tanks for additional circulation and grinding.

20. The method of claim 1, further comprising the steps of:

(a) routing the discharged drill cuttings to a slurrification unit having a first and a second tank;

(b) receiving the discharged drill cuttings into the first tank;

(c) forming a slurry consisting of the received drill cuttings and a liquid in the first tank;

(d) circulating the first tank slurry;

(e) grinding the drill cuttings in the first tank slurry while circulating;

(f) discharging the slurry from the first tank to either or both of the second tank or a holding receptacle;

(g) circulating the received slurry in the second tank;

(h) grinding the drill cuttings in the second tank while circulating;

(i) discharging the second tank slurry;

(j) receiving the discharged second receptacle slurry in the holding receptacle; and (k) injecting the slurries in the holding receptacle into a porous formation via a wellbore.

21. The method of claim 1, further comprising the step of:

(a) spacing the first and second hoppers to coincide with a pair of compartments in the receptacle, the compartment pair having a first and a second compartment; and (b) receiving drill cuttings into the compartment pair first compartment from the first hopper, and receiving drill cuttings into the compartment pair second compartment from the second hopper.

22. The method of claim 21, further comprising the steps of:

(a) moving the first and second hoppers to coincide with an additional pair of compartments in the receptacle, each additional compartment pair having a first and a second compartment;

(b) receiving drill cuttings into the additional compartment pair first compartment from the first hopper, and receiving drill cuttings into the additional compartment pair second compartment from the second hopper; and (c) repeating steps (a)–(b) for more additional compartment pairs, if any.

23. The method of claim 21, further comprising the steps of:

(a) moving the receptacle such that the first and second hoppers coincide with an additional pair of compartments in the receptacle, each additional compartment pair having a first and a second compartment;

(b) receiving drill cuttings into the additional compartment pair first compartment from the first hopper, and receiving drill cuttings into the additional compartment pair second compartment from the second hopper; and (c) repeating steps (a)–(b) for more additional compartment pairs, if any.

24. The method of claim 21, wherein the receptacle is a barge.

25. The method of claim 21, further comprising the steps of:

(a) forming a slurry consisting of the received drill cuttings and a liquid in the compartment pair first compartment;

(b) circulating the first compartment slurry;

(c) grinding the drill cuttings in the first compartment slurry while circulating;

(d) discharging the first compartment slurry;

(e) receiving the discharged first compartment slurry in one or more holding receptacles;

(f) forming a slurry consisting of the received drill cuttings and a liquid in the compartment pair second compartment;

(g) circulating the second compartment slurry;

(h) grinding the drill cuttings in the second compartment slurry while circulating;

(i) discharging the second compartment slurry;

(j) receiving the discharged second compartment slurry in one or more holding receptacles; and (k) injecting the held first and second compartment slurries into a porous formation via a wellbore.

26. The method of claim 1, further comprising the steps of:

(a) mounting the first and second hoppers on a guide fixture such that the hoppers may be moved along the guide fixture; and (b) moving the hoppers along the guide fixture until the hopper discharge openings are positioned above one or more openings of one or more receptacles.

27. The method of claim 26, wherein the receptacle is a barge having one or more open top compartments.

28. The method of claim 26, wherein the step of moving the hoppers along the guide fixture, further comprises the steps of moving the hoppers both laterally and longitudinally with respect to one or more receptacles.

29. The method of claim 26, wherein the step of moving the hoppers along the guide fixture, further comprises the step of moving each hopper independently of the other hopper.

30. The method of claim 1, further comprising the steps of:

(a) mounting the first and second hoppers on a first guide fixture and a second guide fixture, respectively, such that the first and second hoppers may be moved along the first and second guide fixtures; and (b) moving the hoppers along the guide fixtures until the hopper discharge openings are positioned above one or more openings of one or more receptacles.

31. The method of claim 30, wherein the receptacle is a barge having one or more open top compartments.

32. The method of claim 30, wherein the steps of respectively moving the first and second hoppers along the first and second guide fixtures, further comprises the steps of moving either or both of the first and second hoppers both laterally and longitudinally with respect to one or more receptacles.

33. The method of claim 1, further comprising the step of routing the first and second hopper's discharged drill cuttings to a single discharge routing path prior to receipt in a receptacle.

34. The method of claim 1, further comprising the steps of:

(a) routing the first and second hopper's discharged drill cuttings to a single discharge routing path;

(b) directing the single discharge routing path such that the routed drill cuttings are received by a first receptacle until the desired amount of drill cuttings has been received by the first receptacle;

(c) directing the single discharge routing path such that the routed drill cuttings are received by an additional receptacle until the desired amount of drill cuttings has been received by the additional receptacle;

(d) repeating step (c) for more additional receptacles, if any; and (e) repeating steps (a)–(d) for the desired number of cycles.

35. The method of claim 34, further comprising the steps of:

(a) forming a slurry consisting of the received drill cuttings and a liquid in the first receptacle;

(b) circulating the first receptacle slurry;

(c) grinding the drill cuttings in the first receptacle slurry while circulating;

(d) discharging the first receptacle slurry;

(e) receiving the discharged first receptacle slurry in one or more holding receptacles;

(f) forming a slurry consisting of the received drill cuttings and a liquid in the additional receptacle;

(g) circulating the additional receptacle slurry;

(h) grinding the drill cuttings in the additional compartment slurry while circulating;

(i) discharging the additional receptacle slurry;

(j) receiving the discharged additional receptacle slurry in one or more holding receptacles; and (k) injecting the held first and additional receptacle slurries into a porous formation via a wellbore.

36. The method of claim 1, further comprising the steps of:

(a) routing the first and second hopper's discharged drill cuttings to a first single discharge routing path;

(b) directing the first single discharge routing path such that the routed drill cuttings are received by a first receptacle until the desired amount of drill cuttings has been received by the first receptacle;

(c) directing the first and second hopper's discharged drill cuttings to a second single discharge routing path such that the routed drill cuttings are received by a second receptacle until the desired amount of drill cuttings has been received by the second receptacle;

(d) repeating steps (a)–(c) for the desired number of cycles.

37. The method of claim 36, further comprising the steps of:

(a) forming a slurry consisting of the received drill cuttings and a liquid in the first receptacle;

(b) circulating the first receptacle slurry;

(c) grinding the drill cuttings in the first receptacle slurry while circulating;

(d) discharging the first receptacle slurry;

(e) receiving the discharged first receptacle slurry in one or more holding receptacles;

(f) forming a slurry consisting of the received drill cuttings and a liquid in the second receptacle;

(g) circulating the second receptacle slurry;

(h) grinding the drill cuttings in the second compartment slurry while circulating;

(i) discharging the second receptacle slurry;

(j) receiving the discharged second receptacle slurry in one or more holding receptacles; and (k) injecting the held first and second receptacle slurries into a porous formation via a wellbore.

38. The method of claim 1, wherein the step of timing steps (a)–(c), further comprises the steps of:

(a) Setting a timer which will enable steps (a) through (c).

39. The method of claim 1, further comprising the step of adjusting the space between the first and second hoppers, such that the first and second hoppers are appropriately positioned with respect to a first receptacle or a plurality of receptacles.

40. The method of claim 1, further comprising the step of adjusting the space between the first and second hoppers, such that the first and second hoppers are appropriately positioned with respect to a plurality of receptacles.

41. A method of moving drill cuttings from a cuttings collection point for discharge into one or more receptacles, comprising:

(a) Creating a suction force in a common suction line having a first and second end, the common suction line first end being in suction communication with the drill cuttings at the cuttings collection point, the common suction line second end joining and being in alternating suction communication with, a first independent suction line and a second independent suction line, the first and second independent suction lines being in suction communication with a first hopper and a second hopper, respectively, the first and second hoppers being in suction communication with a first independent exit line and a second independent exit line, respectively, the first and second independent exit lines joining to form a common exit line, the common exit line extending ultimately to a suction creating device, the first and second independent exit lines, common exit line and suction creating device being in suction communication;

(b) Removing the suction force from the first hopper by closing a first independent exit line valve and breaking suction communication between the first independent suction line and the common suction line;

(c) Initiating the suction force in the second hopper by opening a second independent exit line valve;

(d) Receiving the drill cuttings from the common suction line, through the second independent suction line, into the second hopper, until the desired amount of drill cuttings are in the second hopper;

(e) Removing the suction force from the second hopper by closing the second independent exit line valve and breaking suction communication between the second independent suction line and the common suction line;

(f) Discharging the drill cuttings from the second hopper through a second hopper discharge opening by opening a second hopper discharge opening valve;

(g) Initiating the suction force in the first hopper by opening the first independent exit line valve and restoring suction communication between the first independent suction line and the common suction line;

(h) Receiving the drill cuttings from the common suction line, through the first independent suction line, into the first hopper, until the desired amount of drill cuttings are in the first hopper;

(i) Removing the suction force from the first hopper by closing the first independent exit line valve and isolating the first independent suction line from the common suction line;

(j) Discharging the drill cuttings from the first hopper through a first hopper discharge opening by opening a first hopper discharge opening valve; and (k) Repeating steps (c) through (j) for a plurality of cycles.

42. The method of claim 41, wherein the timing step further comprises the step of:

(a) timing steps (c)–(j) of claim 41, such that the suctioning force is continuously present in either the first or second hopper.

43. The method of claim 41, wherein the timing step further comprises the step of:

(a) timing steps (c)–(j) of claim 41, such that the suctioning force is continuously present at the cuttings collection point.

44. The method of claim 41, wherein:

(a) the steps of closing the first independent exit line valve, breaking suction communication between the first independent suction line and the common suction line, opening the first hopper discharge opening valve, and opening the second independent exit line valve occur simultaneously; and (b) the steps of closing the second independent exit line valve, breaking suction communication between the second independent suction line and the common suction line, opening the second hopper discharge opening valve, and opening the first independent exit line valve occur simultaneously.

45. The method of claim 41, wherein:

(a) the steps of closing the first independent exit line valve, breaking suction communication between the first independent suction line and the common suction line, opening the first hopper discharge opening valve, and opening the second independent exit line valve occur substantially simultaneously; and (b) the steps of closing the second independent exit line valve, breaking suction communication between the second independent suction line and the common suction line, opening the second hopper discharge opening valve, and opening the first independent exit line valve occur substantially simultaneously.

46. The method of claim 41, wherein the suction creating device is a blower.

47. The method of claim 41, further comprising the step of removing liquids from the air in the common exit line prior to the air entering the suction creating device.

48. A method of moving drill cuttings from a cuttings collection point for discharge into one or more receptacles, comprising:

(a) Alternately suctioning the cuttings from the cuttings collection point to three or more hoppers;

(b) Alternately breaking suction within each of the hoppers;

(c) Alternately discharging the cuttings from each of the hoppers;

(d) Receiving the discharged cuttings from the hoppers into a receptacle; and (e) Timing steps (a)–(c) such that at least one of the hoppers is receiving cuttings while at least one of the other hoppers is discharging.

49. The method of claim 48, wherein the timing step further comprises the step of:

(a) timing steps (a)–(c) of claim 48, such that the suctioning force is continuously present in at least one of the hoppers.

50. The method of claim 48, wherein the timing step further comprises the step of:

(a) timing steps (a)–(c) of claim 48, such that the suctioning force is continuously present at the cuttings collection point.

51. The method of claim 48, wherein:

(a) the steps of suctioning cuttings to a first of the three or more hoppers, breaking suction in at least one of the other hoppers, and discharging cuttings from at least one of the other hoppers begin simultaneously; and (b) the steps of suctioning cuttings to at least one of the other hoppers, breaking suction in the first hopper, and discharging cuttings from the first hopper begin simultaneously.

52. The method of claim 48, wherein:

(a) the steps of suctioning cuttings to a first of the three or more hoppers, breaking suction in at least one of the other hoppers, and discharging cuttings from at least one of the other hoppers begin substantially simultaneously; and (b) the steps of suctioning cuttings to at least one of the other hoppers, breaking suction in the first hopper, and discharging cuttings from the first hopper begin substantially simultaneously.

53. An apparatus for moving drill cuttings from a cuttings collection point for discharge into one or more receptacles, comprising:

a first hopper and a second hopper, each having a cuttings inlet, an air outlet, and a cuttings discharge outlet, a common suction line having a first end and a second end;

a first independent suction line and a second independent suction line, the first independent suction line being in suction communication with the first hopper cuttings inlet and the common suction line second end, the second independent suction line being in suction communication with the second hopper cuttings inlet and the common suction line second end;

suction force means;

a common exit line, having a first end and a second end, the common exit line first end being in suction communication with the suction force means such that the suction force means creates a suction force in the common exit line;

a first independent exit line and a second independent exit line, the first independent exit line being in suction communication with the common exit line second end and the first hopper air outlet, the second independent exit line being in suction communication with the common exit line second end and the second hopper air outlet, the first and second independent exit lines each having a valve;

suction alternating means such that the suction force means repeatedly creates a suction force in one of the first or second hoppers, then the other of the first or second hoppers, but in only one of such hoppers at any one instant, the suction force drawing drill cuttings through the common suction line first end, when the common suction line first end is placed in suction communication with the drill cuttings at the cuttings collection point; and a first hopper discharge valve and a second hopper discharge valve for allowing cuttings to be respectively discharged from the first and second hopper cuttings discharge outlets during intervals in which no suction force is present in the discharging hopper.

54. The apparatus of claim 53, wherein the suction force means is a blower.

55. The apparatus of claim 53, further comprising the suction alternating means, the suction alternating means being such that the suction force is continuously present in either the first or the second hopper.

56. The apparatus of claim 53, further comprising the suction alternating means, the suction alternating means being such that the suction force is continuously present at the cuttings collection point.

57. The apparatus of claim 53, wherein the suction alternating means further comprises a diverter valve positioned on the common suction line such that suction communication between the common suction line and either of the first or the second independent suction lines can be broken, the diverter valve being interconnected with the first independent exit line valve, the second independent exit line valve, the first hopper discharge valve, and the second hopper discharge valve, such that, when the first independent exit line valve closes, the second independent exit line valve opens, the first hopper discharge valve opens, the second hopper discharge valve closes, and the diverter valve breaks suction communication with the first independent suction line, and further such that, when the first independent exit line valve opens, the second independent exit line valve closes, the first hopper discharge valve closes, the second hopper discharge valve opens, and the diverter valve breaks suction communication with the second independent suction line.

58. The apparatus of claim 53, wherein the first independent exit line valve, the second independent exit line valve, the first hopper discharge valve, and the second hopper discharge valve, are interconnected such that, when the first independent exit line valve closes, the second independent exit line valve opens, the first hopper discharge valve opens, and the second hopper discharge valve closes, and further such that, when the first independent exit line valve opens, the second independent exit line valve closes, the first hopper discharge valve closes, and the second hopper discharge valve opens.

59. The apparatus of claim 58, wherein the suction alternating means further comprises a suction-operated first independent suction line valve and a suction-operated second independent suction line valve, the first independent suction line valve closing the first independent suction line when a suction force is in the second independent suction line, the second independent suction line valve closing the second independent suction line when a suction force is in the first independent suction line.

60. The apparatus of claim 53, wherein the first hopper discharge valve, the second hopper discharge valve, and the suction alternating means are coordinated such that the opening of the first hopper discharge valve and the termination of the suction force in the first hopper begin simultaneously, and the opening of the second hopper discharge valve and the termination of the suction force in the second hopper begin simultaneously.

61. The apparatus of claim 53, wherein the first hopper discharge valve, the second hopper discharge valve, and the suction alternating means are coordinated such that the opening of the first hopper discharge valve and the termination of the suction force in the first hopper begin substantially simultaneously, and the opening of the second hopper discharge valve and the termination of the suction force in the second hopper begin substantially simultaneously.

62. The apparatus of claim 53, further comprising a first hopper cuttings vibrator and a second hopper cuttings vibrator, such that cuttings are vibrated when the discharge valves open.

63. The apparatus of claim 53, further comprising one or more jets on each of the first and second hoppers, the air jets being positioned in the hoppers such that the air from the air jet agitates cuttings and dislodges cuttings.

64. The apparatus of claim 53, wherein each of the first and second hopper discharge valves further comprises a hinged flap, hinged with respect to the hopper cuttings discharge outlet such that the hinged flap closes the hopper cuttings discharge outlet when a suction force is present within the hopper.

65. The apparatus of claim 53, further comprising a first hopper clean out access hatch and a second hopper clean out access hatch.

66. The apparatus of claim 53, further comprising a hopper guide frame, the hopper guide frame being configured to support and secure the first and second hoppers, the hopper guide frame further having one or more tracks, the first and second hoppers being movable along such tracks.

67. The apparatus of claim 66, wherein the first and second hoppers are independently movable on the hopper guide frame.

68. The apparatus of claim 66, further comprising hopper automotive means for moving and directing the hoppers along the tracks.

69. The apparatus of claim 53, further comprising:

a hopper support frame, the hopper support frame being configured to support and secure one or more hoppers; and a hopper support frame guide fixture, the hopper support frame guide fixture being sized and configured such that it supports the hopper support frame, the hopper support frame guide fixture having one or more tracks, the hopper support frame being attached to the hopper support frame guide fixture tracks such that the hopper support frame is movable along the hopper support frame guide fixture tracks.

70. The apparatus of claim 69, further comprising hopper automotive means for moving and directing the hopper support frame along the tracks.

71. The apparatus of claim 53, further comprising:

a first hopper support frame and a second hopper support frame, each hopper support frame being configured to support and secure the first and second hoppers, respectively; and a hopper support frame guide fixture, the hopper support frame guide fixture being sized and configured such that it supports the first and second hopper support frames, the hopper support frame guide fixture having one or more tracks, the first and second hopper support frames being attached to the hopper support frame guide fixture tracks such that the first and second hopper support frames are movable along the hopper support frame guide fixture tracks.

72. The apparatus of claim 71, further comprising hopper automotive means for moving and directing the first and second hopper support frames along the tracks.

73. The apparatus of claim 53, further comprising:

a first hopper support frame and a second hopper support frame, each hopper support frame being configured to support and secure the first and second hoppers, respectively; and a plurality of hopper support frame guide fixture, the hopper support frame guide fixtures being sized and configured such that each can support one or more of the first and second hopper support frames, the hopper support frame guide fixtures having a one or more tracks, the first and second hopper support frames being attached to the hopper support frame guide fixture tracks such that the first and second hopper support frames are movable along the hopper support frame guide fixture tracks.

74. The apparatus of claim 73, further comprising hopper automotive means for moving and directing the first and second hopper support frames along the tracks.

75. The apparatus of claim 53, wherein one or more of the first and second independent suction lines are longitudinally expandable and one or more of the first and second independent exit lines are longitudinally expandable, such that the space between the first and second hoppers is variable.

76. The apparatus of claim 53, further comprising a chute, the chute having three or more ends, the chute positioned such that the drill cuttings discharged from the first and second hoppers are received into a first chute end and a second chute end, respectively, the chute being shaped such that the cuttings from the first and second hoppers join prior to exiting the chute.

77. The apparatus of claim 76, wherein the joined drill cuttings exit through a third chute end, the third chute end having a joint, the third chute end being independently directable with respect to the first chute end and the second chute end.

78. The apparatus of claim 76, wherein the joined drill cuttings exit through a third chute end and a fourth chute end, and further wherein the chute has a diverter, such that the joined cuttings can be diverted, in whole or in part, between the third chute end and the fourth chute end.

79. An apparatus for moving drill cuttings from a cuttings collection point for discharge into one or more receptacles, comprising:

a first hopper and a second hopper, each having a cuttings inlet, an air outlet, and a cuttings discharge outlet;

a first hopper suction line and a second hopper suction line, each having a first end, the first hopper suction line being in suction communication with the first hopper cuttings inlet, the second hopper suction line being in suction communication with the second hopper cuttings inlet;

suction force means;

a common exit line, having a first end and a second end, the common exit line first end being in suction communication with the suction force means such that the suction force means creates a suction force in the common exit line;

a first independent exit line and a second independent exit line, the first independent exit line being in suction communication with the common exit line second end and the first hopper air outlet, the second independent exit line being in suction communication with the common exit line second end and the second hopper air outlet;

suction alternating means such that the suction force means repeatedly creates a suction force in one of the first or second hoppers, then the other of the first or second hoppers, but in only one of such hoppers at any one instant, the suction force drawing drill cuttings through either the first hopper suction line or the second hopper suction line, when the first and second hopper suction lines first ends are placed in suction communication with the drill cuttings at the cuttings collection point; and a first hopper discharge valve and a second hopper discharge valve for allowing cuttings to be respectively discharged from the first and second hoppers during intervals in which no suction force is present in the discharging hopper.

80. The apparatus of claim 79, wherein the suction force means is a blower.

81. The apparatus of claim 79, further comprising the suction alternating means, the suction alternating means being such that the suction force is continuously present in either the first or the second hopper.

82. The apparatus of claim 79, further comprising the suction alternating means, the suction alternating means being such that the suction force is continuously present at the cuttings collection point.

83. The apparatus of claim 79, wherein the first independent exit line valve, the second independent exit line valve, the first hopper discharge valve, and the second hopper discharge valve, are interconnected such that, when the first independent exit line valve closes, the second independent exit line valve opens, the first hopper discharge valve opens, and the second hopper discharge valve closes, and further such that, when the first independent exit line valve opens, the second independent exit line valve closes, the first hopper discharge valve closes, and the second hopper discharge valve opens.

84. The apparatus of claim 79, wherein the first hopper discharge valve, the second hopper discharge valve, and the suction alternating means are coordinated such that the opening of the first hopper discharge valve and the termination of the suction force in the first hopper begin simultaneously, and the opening of the second hopper discharge valve and the termination of the suction force in the second hopper begin simultaneously.

85. The apparatus of claim 79, wherein the first hopper discharge valve, the second hopper discharge valve, and the suction alternating means are coordinated such that the opening of the first hopper discharge valve and the termination of the suction force in the first hopper begin substantially simultaneously, and the opening of the second hopper discharge valve and the termination of the suction force in the second hopper begin substantially simultaneously.

86. A method of moving drill cuttings from a cuttings collection point for discharge into one or more receptacles, comprising:

(a) Creating a suction force in a first suction line and a second suction line, each having a first end and a second end, the first and second suction line first ends being in suction communication with the drill cuttings at the cuttings collection point, the first and second suction line second ends being in suction communication with a first independent suction line and a second independent suction line, respectively, the first and second independent suction lines being in suction communication with a first hopper and a second hopper, respectively, the first and second hoppers being in suction communication with a first independent exit line and a second independent exit line, respectively, the first and second independent exit lines joining to form a common exit line, the common exit line extending ultimately to a suction creating device, the first and second independent exit lines, common exit line and suction creating device being in suction communication;

(b) Removing the suction force from the first hopper by closing a first independent exit line valve;

(c) Initiating the suction force in the second hopper by opening a second independent exit line valve;

(d) Receiving the drill cuttings from and through the second independent suction line, into the second hopper, until the desired amount of drill cuttings are in the second hopper;

(e) Removing the suction force from the second hopper by closing the second independent exit line valve;

(f) Discharging the drill cuttings from the second hopper through a second hopper discharge opening by opening a second hopper discharge opening valve;

(g) Initiating the suction force in the first hopper by opening the first independent exit line valve;

(h) Receiving the drill cuttings from and through the first independent suction line, into the first hopper, until the desired amount of drill cuttings are in the first hopper;

(i) Removing the suction force from the first hopper by closing the first independent exit line valve;

(j) Discharging the drill cuttings from the first hopper through a first hopper discharge opening by opening a first hopper discharge opening valve; and (k) Repeating steps (c) through (j) for a plurality of cycles.

87. The method of claim 86, wherein the timing step further comprises the step of:

(a) timing steps (c)–(j) of claim 86, such that the suctioning force is continuously present in either the first or second hopper.

88. The method of claim 86, wherein the timing step further comprises the step of (a) timing steps (c)–(j) of claim 86, such that the suctioning force is continuously present at the cuttings collection point.

89. The method of claim 86, wherein:

(a) the steps of closing the first independent exit line valve, opening the first hopper discharge opening valve, and opening the second independent exit line valve occur simultaneously; and (b) the steps of closing the second independent exit line valve, opening the second hopper discharge opening valve, and opening the first independent exit line valve occur simultaneously.

90. The method of claim 86, wherein:

(a) the steps of closing the first independent exit line valve, opening the first hopper discharge opening valve, and opening the second independent exit line valve occur substantially simultaneously; and (b) the steps of closing the second independent exit line valve, opening the second hopper discharge opening valve, and opening the first independent exit line valve occur substantially simultaneously.

91. The method of claim 86, wherein the suction creating device is a blower.

92. An apparatus for moving drill cuttings from a cuttings collection point for discharge into one or more receptacles, comprising:

a plurality of hoppers, each having a cuttings inlet, an air outlet, and a cuttings discharge outlet, a common suction line having a first end and a second end;

a plurality of independent suction lines, each independent suction line being in suction communication with one of the hopper cuttings inlets and the common suction line second end;

suction force means;

a common exit line, having a first end and a second end, the common exit line first end being in suction communication with the suction force means such that the suction force means creates a suction force in the common exit line;

a plurality of independent exit lines, each independent exit line being in suction communication with the common exit line second end and one of the hopper air outlets, each independent exit line having a valve;

suction alternating means such that the suction force means creates, in succession, a suction force in all of the hoppers, but not in all of the hoppers at any one instant, the suction force drawing drill cuttings through the common suction line first end, when the common suction line first end is placed in suction communication with the drill cuttings at the cuttings collection point; and a plurality of hopper discharge valves for allowing cuttings to be respectively discharged from each of the hoppers' cuttings discharge outlets during intervals in which no suction force is present in the discharging hopper.

93. The apparatus of claim 92, wherein the suction force means is a blower.

94. The apparatus of claim 92, further comprising the suction alternating means, the suction alternating means being such that the suction force is continuously present in at least one of the hoppers.

95. The apparatus of claim 92, further comprising the suction alternating means, the suction alternating means being such that the suction force is continuously present at the cuttings collection point.

96. The apparatus of claim 92, wherein the suction alternating means further comprises a diverter valve positioned on the common suction line such that suction communication between the common suction line and any of the independent suction lines can be broken, the diverter valve being interconnected with the independent exit line valves, and the hopper discharge valves, such that, in succession, when the discharging hopper's independent exit line valves closes, the other independent exit line valves open, the discharging hopper's discharge valve opens, the other discharge valves close, and the diverter valve breaks suction communication with the discharging hopper's independent suction line.

97. The apparatus of claim 92, wherein the independent exit line valves and the hopper discharge valves are interconnected such that, in succession when the discharging hopper's independent exit line valve closes, the other independent exit line valves open, the discharging hopper's discharge valve opens, and the other hopper discharge valves close.

98. The apparatus of claim 92, wherein the hopper discharge valves and the suction alternating means are coordinated such that the opening of each discharging hopper's discharge valve, and the termination of the suction force in each such discharging hopper, begin simultaneously.

99. The apparatus of claim 92, wherein the hopper discharge valves and the suction alternating means are coordinated such that the opening of each discharging hopper's discharge valve, and the termination of the suction force in each such discharging hopper, begin substantially simultaneously.

100. An apparatus for moving drill cuttings from a cuttings collection point for discharge into one or more receptacles, comprising:

a plurality of hoppers, each having a cuttings inlet, an air outlet, and a cuttings discharge outlet, a common suction line having a first end and a second end;

a plurality of independent suction lines, each independent suction line being in suction communication with one of the hopper cuttings inlets and the common suction line second end;

suction force introduction means for allowing a suction force to be created in the common exit line;

a common exit line, having a first end and a second end, the common exit line first end being in suction communication with the suction force means such that the suction force means creates a suction force in the common exit line;

a plurality of independent exit lines, each independent exit line being in suction communication with the common exit line second end and one of the hopper air outlets, each independent exit line having a valve;

suction alternating means such that the suction force means creates, in succession, a suction force in all of the hoppers, but not in all of the hoppers at any one instant, the suction force drawing drill cuttings through the common suction line first end, when the common suction line first end is placed in suction communication with the drill cuttings at the cuttings collection point; and a plurality of hopper discharge valves for allowing cuttings to be respectively discharged from each of the hoppers' cuttings discharge outlets during intervals in which no suction force is present in the discharging hopper.

101. The apparatus of claim 100, wherein the suction force introduction means comprises attachment hardware whereby the common exit line is mechanically connected to a suction creating device, or devices in suction communication with a suction creating device, such that the common exit line is in suction communication with the suction creating device.

102. The apparatus of claim 101, wherein the suction creating device is a blower.

* * * * *